US009196201B2

(12) United States Patent
Fujimori et al.

(10) Patent No.: US 9,196,201 B2
(45) Date of Patent: Nov. 24, 2015

(54) METHOD FOR CONTROLLING ELECTRO-OPTIC DEVICE, DEVICE FOR CONTROLLING ELECTRO-OPTIC DEVICE, ELECTRO-OPTIC DEVICE, AND ELECTRONIC APPARATUS

(71) Applicant: SEIKO EPSON CORPORATION, Tokyo (JP)

(72) Inventors: Keitaro Fujimori, Fujimi-machi (JP); Takafumi Sano, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 429 days.

(21) Appl. No.: 13/830,546

(22) Filed: Mar. 14, 2013

(65) Prior Publication Data

US 2013/0249886 A1 Sep. 26, 2013

(30) Foreign Application Priority Data

Mar. 26, 2012 (JP) ..... 2012-069215

(51) Int. Cl.
*G09G 3/34* (2006.01)
*G09G 3/20* (2006.01)

(52) U.S. Cl.
CPC ..... *G09G 3/344* (2013.01); *G09G 3/2007* (2013.01); *G09G 2300/0842* (2013.01); *G09G 2310/06* (2013.01)

(58) Field of Classification Search
CPC . G09G 3/344; G09G 2310/06; G09G 3/2007; G09G 2300/0842
USPC ..... 345/85, 107, 212
See application file for complete search history.

(56) References Cited

U.S. PATENT DOCUMENTS

| | | | |
|---|---|---|---|
| 2005/0001812 | A1 | 1/2005 | Amundson et al. |
| 2005/0024353 | A1 | 2/2005 | Amundson et al. |
| 2005/0062714 | A1 | 3/2005 | Zehner et al. |
| 2005/0152018 | A1 | 7/2005 | Abramson et al. |
| 2005/0179642 | A1 | 8/2005 | Wilcox et al. |
| 2005/0270261 | A1 | 12/2005 | Danner et al. |
| 2005/0280626 | A1 | 12/2005 | Amundson et al. |
| 2006/0202949 | A1 | 9/2006 | Danner et al. |
| 2006/0262060 | A1 | 11/2006 | Amundson |
| 2007/0091418 | A1 | 4/2007 | Danner et al. |
| 2007/0146306 | A1 | 6/2007 | Johnson et al. |
| 2007/0200874 | A1 | 8/2007 | Amundson et al. |
| 2008/0129667 | A1 | 6/2008 | Zehner et al. |
| 2008/0309953 | A1 | 12/2008 | Feng |
| 2009/0195568 | A1 | 8/2009 | Sjodin |
| 2009/0256799 | A1 | 10/2009 | Ohkami et al. |
| 2011/0187684 | A1 | 8/2011 | Amundson et al. |
| 2011/0193841 | A1 | 8/2011 | Amundson et al. |

FOREIGN PATENT DOCUMENTS

WO 2005/101363 A2 10/2005

*Primary Examiner* — Rodney Amadiz
(74) *Attorney, Agent, or Firm* — Maschoff Brennan

(57) ABSTRACT

A method for controlling an electro-optic device includes a third, a fourth, a first, and a second control steps of supplying a third, a fourth, a first, and a second voltage pulse, in this order. In the first control step, a first limit optical state is reached. In the second control step, a first intermediate optical state is reached. The period of each of the third control step and the fourth control step is set to satisfy a relation W (A→B)=−W (B→A), where W (A→B) is an integrated value of drive voltage and drive time when changing the pixel from an optical state A to an optical state B, and W (B→A) is an integrated value of drive voltage and drive time when changing the pixel from the optical state B to the optical state A.

12 Claims, 17 Drawing Sheets

| LEVEL | WHT |
|---|---|
| 0 | 0 |
| 1 | 3 |
| 2 | 5 |
| 3 | 6 |
| 4 | 9 |
| 5 | 10 |
| 6 | 11 |
| 7 | 12 |

FIG. 12

METHOD FOR CONTROLLING ELECTRO-OPTIC DEVICE, DEVICE FOR CONTROLLING ELECTRO-OPTIC DEVICE, ELECTRO-OPTIC DEVICE, AND ELECTRONIC APPARATUS

BACKGROUND

1. Technical Field

The present invention relates to methods for controlling an electro-optic device, devices for controlling an electro-optic device, electro-optic devices, and electronic apparatuses.

2. Related Art

An electrophoretic display device is one example of the electro-optical devices described above. The electrophoretic display device displays images at a display section by applying voltages between pixel electrodes and an opposing counter electrode with electrophoretic elements containing electrophoretic particles sandwiched therebetween, thereby migrating electrophoretic particles, such as, black particles and white particles. The electrophoretic elements are composed of a plurality of microcapsules each containing a plurality of electrophoretic particles, and affixed between the pixel electrodes and the counter electrode with an adhesive composed of resin or the like. Note that the counter electrode may also be called a common electrode.

With such an electrophoretic display device, for example, white color can be displayed by applying a voltage that moves white particles to the display surface side, and black color can be display by applying voltage that moves black particles to the display surface side. Also, by adjusting the period for applying the voltage for white color or black color described above, an intermediate gray level between white color and black color (in other words, gray color) can be displayed (see, for example, U.S. Published Patent Application 2005/0001812 (Patent Document 1), U.S. Published Patent Application 2005/0280626 (Patent Document 2) and WIPO Published Patent Application WO/2005/101363 (Patent Document 3)).

For displaying the intermediate gray level, each of the particles may only have to be moved to the middle position between white and black displays. However, such a control is difficult, and variations might be generated in the gray level to be displayed because, for example, differences occur in the positions of the respective particles. In particular, when plural intermediate gray levels are to be displayed, the variations described above greatly impact on the display image.

In contrast, for example, when the gray level is changed from light gray (that is, gray color close to white) to dark gray (that is, gray color close to black), each particle may be once moved to the position for displaying the white color or the black color from the state where the light gray is displayed, and then moved to the position for displaying the dark gray. As a result, the positions of the particles for each of the pixels can be made uniform and the intermediate gray level can be suitably displayed.

However, as described above, when voltages of mutually different polarities are alternately impressed for rewriting, bias may be caused in the polarities of the voltages impressed to the pixels through the overall rewriting process. Concretely, a difference may occur between the period in which the voltage with a polarity corresponding to white is impressed and the period in which the voltage with a polarity corresponding to black is impressed.

According to the research conducted by the inventor, if such bias is caused in the polarities as described above, it has been found that troubles, such as, for example, image burn-in and deterioration of the display section may occur. However, the technical documents of related art described above do not refer to the bias in polarities at all. In other words, the related art including the technical documents described above has a technical problem in that generation of bias in the polarities to be impressed to pixels cannot be prevented.

SUMMARY OF THE INVENTION

In accordance with some aspects of the invention, there are provided a method for controlling an electro-optic device, a device for controlling an electro-optic device, an electro-optic device, and an electronic apparatus, which can prevent a bias from being generated in polarities of voltage to be applied to pixels, and therefore can excellently display intermediate gray levels.

A method for controlling an electro-optic device having a display section including a plurality of pixels provided at positions corresponding to intersections between mutually intersecting plural scanning lines and plural data lines, each of the pixels including electro-optic material placed between mutually opposing pixel electrode and counter electrode, and capable of assuming a first limit optical state, a second limit optical state and a plurality of intermediate optical states between the first limit optical state and the second limit optical state, and a drive part that supplies, for displaying an image corresponding to image data at the display section, voltage pulses according to the image data to the pixel electrode of each of the pixels in a plurality of frame periods. A control process for changing the pixel to a first intermediate optical state among the plurality of intermediate optical states includes a first control step of supplying a first voltage pulse to the pixel electrode until the pixel reaches the first limit optical state, a second control step of supplying a second voltage pulse having an opposite polarity with respect to the first voltage pulse to the pixel electrode after the first control step such that the pixel becomes closer to the first intermediate optical state, a third control step of supplying a third voltage pulse to the pixel electrode before the first control step, and a fourth control step of supplying a fourth voltage pulse having an opposite polarity with respect to the third voltage pulse to the pixel electrode between the third control step and the first control step. Each of the third control step and the fourth control step is set to a period that satisfies a relation $W(A \rightarrow B) = -W(B \rightarrow A)$, where $W(A \rightarrow B)$ is an integrated value of drive voltage and drive time when changing the pixel from an optical state A to an optical state B, and $W(B \rightarrow A)$ is an integrated value of drive voltage and drive time when changing the pixel from the optical state B to the optical state A.

An electro-optical device that is controlled by the method of controlling an electro-optical device in accordance with an embodiment of the invention is equipped with a display section including a plurality of pixels arrayed in a matrix at places corresponding to intersections between a plurality of scanning lines and a plurality of data lines. The display section has electro-optical material between mutually opposing pixel electrode and counter electrode. Also, the plurality of pixels may be able to assume a first limit optical state, a second limit optical state, and a plurality of intermediate optical states between the first limit optical state and the second limit optical state.

Note here that the "limit optical state" is an optical state achieved by impressing a predetermined voltage sufficiently to the electro-optic material in the display section. However, the "limit optical state" in the invention not only means a state in which the optical state does not change at all even if the predetermined voltage impressed further from that optical state, but also includes a wider concept including, for example, an optical state in which plural pixels concurrently assume the limit optical state whereby the optical state of each of the pixels is made uniform to the extent that differences in the optical state among the pixels (to be described later) can be reduced. Concretely, for example, when the electro-optic material is composed as an electrophoretic element including white particles and black particles, an optical state in which white color is displayed by the white particles being drawn sufficiently to the display surface side, or an optical state in which black color is displayed by the black particles being drawn sufficiently to the display surface side corresponds to the "limit optical state" in accordance with the invention.

Also, the "intermediate optical state" means an optical state in between the first limit optical state and the second limit optical state, and corresponds, for example, to an optical state in which a gray color is displayed, when the optical state of displaying the white color or the black color is assumed to be the limit optical state as described above. The "intermediate optical state" may be achieved by, for example, adjusting the period of impressing the voltage for changing the optical state to the first limit optical state, or the voltage for changing the optical state to the second limit optical state. More concretely, for example, by moving the white particles and the black particles contained in the electrophoretic element to an intermediate position between the positions where white color and black colors are displayed, a gray color that defines the intermediate optical state can be displayed.

In the display section in accordance with the embodiment, each of the pixels can assume a plurality of intermediate optical states, such as, for example, light gray, dark gray, etc. Such plural intermediate optical states can be displayed by adjusting the position of each particle between the pixel electrode and the counter electrode. More concretely, light gray can be displayed by placing white particles at an intermediate position relatively near the display surface side (or, black particles are placed at an intermediate position relatively far from the display surface side), and dark gray can be displayed by placing white particles at an intermediate position relatively far from the display surface side (or, black particles are placed at an intermediate position relatively near the display surface side).

The display section described above is controlled by the drive part in a manner to display an image corresponding to image data. More concretely, when the electro-optic device according to the embodiment is operating, voltage pulses corresponding to the image data are supplied to each of the pixel electrodes of the plural pixels by the drive part. As a result, the voltage corresponding to the image data is impressed to each of the pixels, and the image corresponding to the image data is displayed in the display section.

The voltage pulses are supplied to each pixel by the drive part over a plurality of frame periods. In other words, the voltages are impressed to the pixels in the display section multiple times in the unit of a frame period. Concretely, the plural scanning lines are sequentially selected once in a predetermined order in each frame period, and voltage pulses are supplied to the pixel electrodes at the pixels corresponding to the selected scanning line through the plural data lines. Note that the "frame period" here is a predetermined period during which the plural scanning lines are selected once in a predetermined order. In other words, the supply of the voltage pulse to the pixel electrode at each of the plural pixels is controlled once in each of the consecutive plural frame periods, whereby the image corresponding to the image data is displayed in the display section.

According to the method of controlling an electro-optic device in accordance with the embodiment of the invention, when the pixel is to be shifted to the first intermediate optical state, four control steps, the first control step, the second control step, the third control step, and the fourth control step, are performed. Concretely, each of the control steps is performed in the order of the third control step, the fourth control step, the first control step, and the second control step. Each of the control steps may include a process step other than the first control step, the second control step, the third control step, and fourth control step. In other words, a step of supplying a voltage pulse to the pixel electrode of a rewriting pixel may exist besides these four control steps. Note that the "first intermediate optical state" here is an intermediate optical state aimed at in rewriting the image, and may be set as one optical state among the plural intermediate optical states that can be assumed by the pixels in the display section.

In the first control step, a voltage (for example, −15V) corresponding to the first limit optical state (for example, white) is impressed to pixels that are to assume the first intermediate optical state in the display section (hereafter referred to as "rewriting pixels" if appropriate). As a result, the rewriting pixels assume the first limit optical state. In this manner, the optical state at the plural pixels can be made uniform by changing it to the limit optical state once before the rewriting pixels are changed to assume the first intermediate optical state. Concretely, for example, the positions of the particles contained in the electrophoretic element can be made uniform. Therefore, when the rewriting pixels are changed to the intermediate optical state, noise or the like, that may result from differences generated in the optical state among the plural pixels, can be prevented from being generated in the image to be displayed. When the optical state before rewriting is already the first limit optical state, the first control step may be omitted.

In the second control step, a voltage (for example, +15V) corresponding to the second limit optical state (for example, black) is impressed to the rewriting pixels. In other words, a voltage of a reverse-polarity with respect to the first control step is impressed in the second control step. As a result, the optical state at the rewriting pixels is brought close to the first intermediate optical state. Therefore, the pixels that are made to assume the first limit optical state in the first control step can be made to assume the first intermediate optical state or a state close to the first intermediate optical state.

In the third control step, a third voltage pulse is supplied to the pixel electrodes of the rewriting pixels. Moreover, in the fourth control step, a fourth voltage pulse of a reverse-polarity with respect to the third voltage pulse is supplied to the pixel electrodes of the rewriting pixels. According to the third control step and the fourth control step, the voltage of the same polarity as that of the first voltage pulse to be supplied in the first control step and the voltage of the same polarity as that of the second voltage pulse to be supplied in the second control step are respectively supplied, prior to the first control step and the second control step that form the substantial rewriting process. Concretely, when the third voltage pulse to be supplied in the third control step and the first voltage pulse to be supplied in the first control step have the same polarity, the fourth voltage pulse having the same polarity of the second voltage pulse to be supplied in the second control step is supplied in the fourth control step. Alternatively, when the third voltage pulse to be supplied in the third control step and the second voltage pulse to be supplied in the second control step have the same polarity, the fourth voltage pulse having the same polarity of the first voltage pulse to be supplied in the first control step is supplied in the fourth control step.

In particular, each of the third control step and the fourth control step is set to a period that satisfies a relation W (A→B)=−W (B→A), where W (A→B) is an integrated value of drive voltage and drive time when changing the pixel from an optical state A to an optical state B, and W (B→A) is an integrated value of drive voltage and drive time when changing the pixel from the optical state B to the optical state A. Note that the "drive voltage" here is a voltage to be impressed to the pixel in each of the first control step, the second control step, the third control step and the fourth control step, and the "drive time" means each period in the first control step, the second control step, the third control step, and the fourth control step (in other words, the period when the drive voltage is impressed).

Concretely, for example, if the optical state in the display section is changed from level 0 to level 7 by eight stages, the integrated value of the drive voltage and the drive time W (2→5) when the optical state is changed from level 2 to level 5, and the integrated value of the drive voltage and drive time W (5→2) when the optical level is changed from level 5 and to level 2 have equal absolute values. Similarly, the integrated value of the drive voltage and the drive time W (6→4) when the optical state is changed from level 6 to level 4, and the integrated value of the drive voltage and drive time W (4→6) when the optical level is changed from level 4 and to level 6 have equal absolute values. Note here that the term "equal" refers to a wide concept that includes the state in which the absolute values of the integrated values completely correspond to each other and the state in which these values are close to each other to the extent that the effect of the invention to be described later can be demonstrated.

Deviations can be prevented from being generated in the polarities of the voltages impressed to the rewriting pixels if the relation of W (A→B)=−W (B→A) described above is satisfied. Concretely, the difference between the period in which the voltage pulse corresponding to the first limit optical state is supplied and the period in which the voltage pulse corresponding to the second limit optical state is supplied can be reduced. Therefore, the DC balance ratio at the pixels can be controlled so as not to collapse, and troubles of image burn-in and deterioration of the display section can be effectively prevented.

Note that it is extremely difficult to achieve the relation of W(A→B)=−W(B→A), only by the first control step and the second control step, in the display section that uses an electrophoretic element, such as, for example, an EPD (Electrophoretic Display), because of its nonlinear characteristic. However, in accordance with the embodiment of the invention, the relation of W(A→B)=−W(B→A) can be suitably achieved by adjusting each period of the third control step and the fourth control step, because the third control step and the fourth control step are performed before the first control step and the second control step.

As described above, according to the method of controlling an electro-optic device according to the embodiment of the invention, while keeping the DC balance by the third control step and the fourth control step, a desired intermediate optical state can be suitably achieved. As a result, a high-quality image can be displayed in the electro-optic device, while achieving high reliability.

In the method of controlling an electro-optic device in accordance with an aspect of the embodiment, the period in each of the third control step and the fourth control step may be set such that the optical state before the beginning of the third control step is the same as the optical state after the end of the fourth control step.

According to the aspect described above, even when the third control step and the fourth control step are performed, the optical state of the pixels rewritten does not change before and after these steps. Therefore, the period of the first control step and the second control step can be set without depending on the third control step and the fourth control step. Therefore, the period in each of the control steps can be very easily set.

In the method of controlling an electro-optic device in accordance with another aspect of the embodiment, the third voltage pulse may have the same polarity as that of the second voltage pulse, and the fourth voltage pulse may have the same polarity as that of the first voltage pulse.

According to this aspect, the third voltage pulse of one polarity is first supplied in the third control step, then the fourth voltage pulse and the first voltage pulse of another polarity are supplied one by one in the following fourth control step and the first control step, and the second voltage pulse of the one polarity is supplied again in the second control step.

In other words, the voltage pulses of the same polarity are continuously supplied in the fourth control step and the first control step.

As a result, compared to the case where the third voltage pulse and the first voltage pulse are in the same polarity, and the fourth voltage pulse and the second voltage pulse are in the same polarity, the processing can be made simpler to the extent that fewer switching of the polarities takes place.

In the method of controlling an electro-optic device in accordance with another aspect of the embodiment, in the second control step, the second voltage pulse may be supplied to the pixel electrode until the first intermediate optical state or an intermediate optical state that is close to the second limit optical state more than the first intermediate optical state is reached, and the control step for changing the pixel to the first intermediate optical state may further include a fifth control step of supplying a fifth voltage pulse of the same polarity as that of the first voltage pulse to the pixel electrode until the first intermediate optical state is reached, when, after the second control step, the pixel is in an intermediate optical state that is close to the second limit optical state more than the first intermediate optical state.

According to this aspect, in addition to the first control step, the second control step, the third control step, and the fourth control step described above, the fifth control step is included in the control process. In the control process, the third control step, the fourth control step, the first control step, the second control step, and the fifth control step are performed in this order.

In the embodiment, in particular, the optical state of the rewriting pixel after the second control step is the first intermediate optical state or an optical state close to the second limit optical state more than the first intermediate optical state. In other words, the optical state of the rewriting pixel after the second control step is not brought to an optical state close to the first limit optical state more than the first intermediate optical state.

In the fifth control step following the second control step, a voltage corresponding to the first limit optical state is impressed again to the rewriting pixel that has assumed an optical state close to the second limit optical state more than the first intermediate optical state. As a result, the optical state of the rewriting pixel is brought close to the first limit optical state. In other words, it is brought close to the first intermediate optical state further. The voltage impressed in the fifth control step may be in the same value as the voltage impressed by the first control step, or may be a different value. In other words, the voltage impressed in the first control step and the voltage impressed in the fifth control step may have mutually different values, as long as they are in the same polarity.

In particular, according to the research conducted by the inventor, when the optical state is changed from the first limit optical state to another optical state, it always turns out that the change rate of the optical state to the period when the voltage is impressed does not become constant. Concretely, the change in the optical state tends to become smaller as it approaches the second limit optical state, though the change in the optical state immediately after the beginning of rewriting from the first limit optical state in a direction to the second limit optical state is large. Note that such a characteristic similar appears in rewriting from the second limit optical state, wherein the change in the optical state tends to become smaller as it approaches the first limit optical state, while the change in the optical state immediately after the beginning of rewriting from the second limit optical state in a direction to the first limit optical state is large.

Therefore, for example, when light gray close to white is to be displayed from the state in which white is displayed, a gray color close to black more than the light gray that should be displayed might be displayed only by the impression of a voltage only for one frame period. In other words, because the change rate of the optical state immediately after the beginning of rewriting is too large, the situation may occur in which displaying an intermediate optical state close to the optical state before the beginning of rewriting becomes very difficult.

Accordingly, in the present embodiment as described above, rewriting after the first control step from the first limit optical state to the first intermediate optical state is performed separately in divided two steps, the second control step and the fifth control step. Therefore, even if the optical state of the rewriting pixel assumes an optical state close to the second limit optical state more than the first intermediate optical state, due to rewriting from the first limit optical state in a direction to the second limit optical state in which the change rate of optical state is relatively high (that is, the second control step), the optical state can be fine-tuned by rewriting in a direction to the first limit optical state in which the change rate of optical state is low (that is, the fifth control step). Therefore, the optical state much closer to the first intermediate optical state can be achieved.

In the method of controlling an electro-optic device in accordance with another aspect of the embodiment, an absolute value of the integrated value W (A→B) of drive voltage and drive time when changing the pixel from the optical state A to the optical state B becomes greater, as an absolute value of a difference between the optical state A to the optical state B becomes greater.

According to this aspect, the difference between the optical state before rewiring and the optical state after rewriting (in other words, the amount of change in the optical state due to rewriting) corresponds to the absolute value of the integrated value for changing the optical state, each period of the third control step and the fourth control step can be set to satisfy the relation W (A→B)=−W(B→A) easily and reliably.

In the method of controlling an electro-optic device in accordance with another aspect of the embodiment, an integrated value of drive voltage and drive time W (A→C→B) when changing the pixel from the optical state A to an optical state C and then to the optical state B may become equal to the integrated value of drive voltage and drive time W (A→B) when changing the pixel from the optical state A to the optical state B.

According to this aspect of the embodiment, when the pixel is shifted from the optical state A to the optical state B, even if the pixel is shifted via another optical state C once, the integrated value of drive voltage and drive time does not change. Therefore, without depending on what optical state the pixel assumed on the way, the period of the third control step and the fourth control step can be set based on the optical state A before the shift and the optical state B after the shift.

In the present embodiment, the integrated value W(A→C→B) becomes equal to the integrated value W(A→B), and therefore it goes without saying that the relation of the integrated value W(A→C→B)=−W(B→A) will be satisfied.

In the method of controlling an electro-optic device in accordance with another aspect of the embodiment, each of the periods of the third control step and the fourth control step is set by using a weight table decided based on the relation between the optical states and the integrated values of drive voltage and drive time.

According to this aspect of the embodiment, the weight table is decided beforehand based on the relation between the optical states and the integrated values of drive voltage and drive time. For example, integrated values of drive voltage and drive time each corresponding to each of the optical states are set to the weight table. When rewriting an image, the period of each of the control steps is set according to a difference between an integrated value corresponding to the optical state before the rewriting and an integrated value corresponding to the optical state after the rewriting.

By using the weight table, the period of each of the control steps can be set only by simply selecting a numerical value from the table. Therefore, the image rewriting can be performed very easily, while satisfying the relation of W(A→B)=−W(B→A).

In the aspect that uses the weight table described above, the weight table has one weight value for each reference optical state. When the weight value of an arbitrary optical state Li is WHT(Li) and the weight value of an optical state Lj is WHT (Lj), the weight value may be decided in such a manner that the integrated value of drive voltage and drive time W(Li→Lj) when shifting the pixel from the optical state Li to the optical state Lj becomes proportional to WHT(Lj)−WHT (Li).

In this case, for example, reference optical states of eight stages from level 0 to level 7 as described above are set in the weight table. Values each corresponding to one weight value (in other words, an integrated value of drive voltage and drive time) is set for each of the reference optical states.

In accordance with the present embodiment, the weight table is decided in such a manner that the integrated value of drive voltage and drive time W(Li→Lj) when an arbitrary optical state Li is shifted to an optical state Lj becomes proportional to the difference between the weight values corresponding to the respective optical states (that is, WHT(Lj)−WHT(Li)). By deciding the weight table in this manner, the weight value corresponding to each of the optical states can be set to an appropriate value (in other words, the relation between the optical state and its corresponding weight value can be made appropriate). Therefore, the relation of W(A→B)=−W(B→A) can be reliably achieved.

In the embodiment that uses the weight table described above, the weight table may have one weight value for each reference optical state, and the weight value may be decided in a manner to increase or decrease monotonously with respect to the optical state.

In this case, if the reference optical states are set by eight stages from level 0 to level 7, as described above, for example, the greater the level of the optical state, the greater the weight value may become (monotonically increase). Concretely, the weight value corresponding to level 1 is larger than the weight value corresponding to level 0, and the weight value corresponding to level 2 is greater than the weight value corresponding to level 1. Alternatively, the greater the level of the optical state, the smaller the weight value may become (monotonically decrease). Concretely, the weight value corresponding to level 1 is smaller than the weight value corresponding to level 0, and the weight value corresponding to level 2 is smaller than the weight value corresponding to level 1.

By deciding the weight table in a manner described above, the weight value corresponding to each of the optical states can be set to an appropriate value (in other words, the relation between the optical state and its corresponding weight value can be made appropriate). Therefore, the relation of $W(A \rightarrow B) = -W(B \rightarrow A)$ can be reliably achieved.

A control device for controlling an electro-optic device in accordance with an embodiment of the invention includes a display section including a plurality of pixels provided at positions corresponding to intersections between mutually intersecting plural scanning lines and plural data lines, each of the pixels including electro-optic material placed between mutually opposing pixel electrode and counter electrode, and capable of assuming a first limit optical state, a second limit optical state and a plurality of intermediate optical states between the first limit optical state and the second limit optical state, and a drive part that supplies, for displaying an image corresponding to image data at the display section, voltage pulses according to the image data to the pixel electrode of each of the pixels in a plurality of frame periods. The control device includes, when changing the pixel to a first intermediate optical state among the plurality of intermediate optical states, a first control device that supplies a first voltage pulse to the pixel electrode until the pixel reaches the first limit optical state, a second control device that supplies a second voltage pulse of an opposite polarity with respect to the first voltage pulse to the pixel electrode after the first voltage pulse is supplied by the first control device such that the pixel becomes closer to the first intermediate optical state, a third control device that supplies a third voltage pulse to the pixel electrode before the first voltage pulse is supplied by the first control device, and a fourth control device that supplies a fourth voltage pulse of an opposite polarity with respect to the third voltage pulse to the pixel electrode after the third voltage pulse is supplied by the third control device and before the first voltage pulse is supplied by the first control device. The period in which the third control device supplies the third voltage pulse and the period in which the fourth control device supplies the fourth voltage pulse are set to satisfy a relation of $W(A \rightarrow B) = -W(B \rightarrow A)$, where $W(A \rightarrow B)$ is an integrated value of drive voltage and drive time when changing the pixel from an arbitrary optical state A to an optical state B, and $W(B \rightarrow A)$ is an integrated value of drive voltage and drive time when changing the pixel from the optical state B to the optical state A.

According to the control device for controlling an electro-optic device according to the embodiment of the invention, while keeping the DC balance, a desired intermediate optical state can be suitably achieved, similarly to the method of controlling an electro-optic device described above. As a result, a high-quality image can be displayed in the electro-optic device, while achieving high reliability.

Note that various embodiments similar to the embodiments of the method for controlling an electro-optic device according to the invention described above can be implemented in the control device for controlling an electro-optic device in accordance with the invention.

In accordance with an embodiment of the invention, an electro-optic device has the control device for controlling an electro-optic device in accordance with the invention described above (also, including its various modifications).

Because the electro-optic device according to the embodiment of the invention is equipped with the control device for controlling an electro-optic device in accordance with the invention described above, a desired intermediate optical state can be suitably achieved, while keeping the DC balance. As a result, an electro-optic device that can display a high-quality image, while achieving high reliability, can be realized.

In accordance with still another embodiment of the invention, an electronic apparatus is equipped with the electro-optic device according to the invention described above (also including its various embodiments).

Because the electronic apparatus in accordance with the invention is equipped with the electro-optic device according to the invention described above, various electronic apparatuses, such as, wristwatches, electronic paper, electronic notepads, cellular phones, portable audio equipment and the like, which are dependable and capable of displaying high-quality images, can be realized.

The effects and other advantages of the invention will be clarified from embodiments to carry out the invention described below.

BRIEF DESCRIPTION OF THE DRAWINGS

FIG. 12 is a table figure showing one example of a weight table.

DESCRIPTION OF EXEMPLARY EMBODIMENTS

Preferred embodiments of the invention will be described below with reference to the accompanying drawings.

Electro-Optic Device

An electro-optic device in accordance with the present embodiment will be described with reference to FIGS. 1 through 18. In the embodiment described below, an electrophoretic display device of an active matrix driving type will be enumerated as one example of the electro-optic device in accordance with the invention.

First, an overall configuration of the electrophoretic display device in accordance with the present embodiment will be described, with reference to FIGS. 1 to 3.

Figure 1:
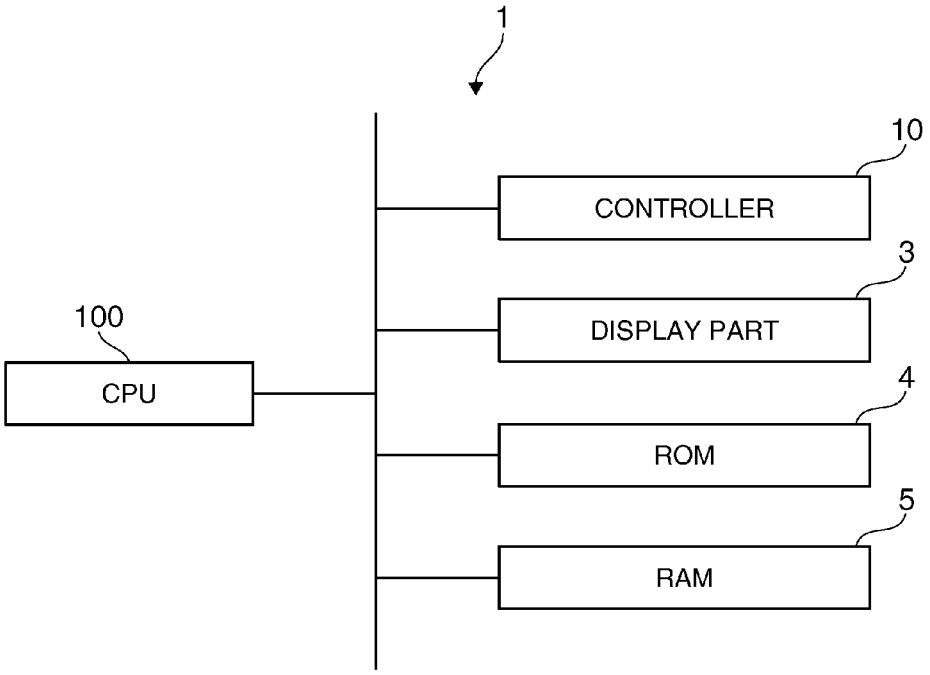
FIG. 1 is a block diagram showing an overall configuration of an electrophoretic display device in accordance with an embodiment of the invention.

FIG. 1 is a block diagram showing an overall configuration of the electrophoretic display device in accordance with the present embodiment.

The electrophoretic display device 1 in accordance with the present embodiment shown in FIG. 1 is equipped with a display section 3, a ROM 4, a RAM 5, a controller 10, and a CPU 100.

The display section 3 is a display device that has a display element having memory property, which maintains a display state even in a state in which writing is not conducted. Note that the memory property is a property that, when entering a predetermined display state by application of voltage, would maintain the display state, even when the voltage impression is removed, which is also called bistability. A concrete configuration of the display section 3 will be described in detail later.

The ROM 4 is a device that stores data to be used when the electrophoretic display device 1 is operated. For example, the ROM 4 stores a waveform table of drive voltages to achieve a display state targeted at each of the pixels. The waveform table of drive voltages will be described in detail later. Note that the ROM 4 can be substituted by a rewritable storage device such as a RAM.

The RAM 5 is a device that stores data used when the electrophoretic display device 1 is operated, similarly to the ROM 4 described above. The RAM 5 stores, for example, data indicative of a display state before a rewriting operation and data indicative of a display state after the rewriting operation, changes. Also, the RAM 5 includes a VRAM, etc. that function, for example, as a frame buffer, and stores frame image data based on the control of the CPU 100.

The controller 10 controls the display operation of the display section 3 by using the data stored in the ROM 4 and the RAMS described above. The controller 10 controls the display section 3 by outputting an image signal indicative of an image to be displayed in the display section 3 and various other signals (for example, a clock signal, etc.)

The CPU 100 is a processor that controls the operation of the electrophoretic display device 1, and reads and writes data by executing programs stored in advance. The CPU 100 renders the VRAIVI to store image data to be displayed in the display section 3 when the image is rewritten.

Figure 2:
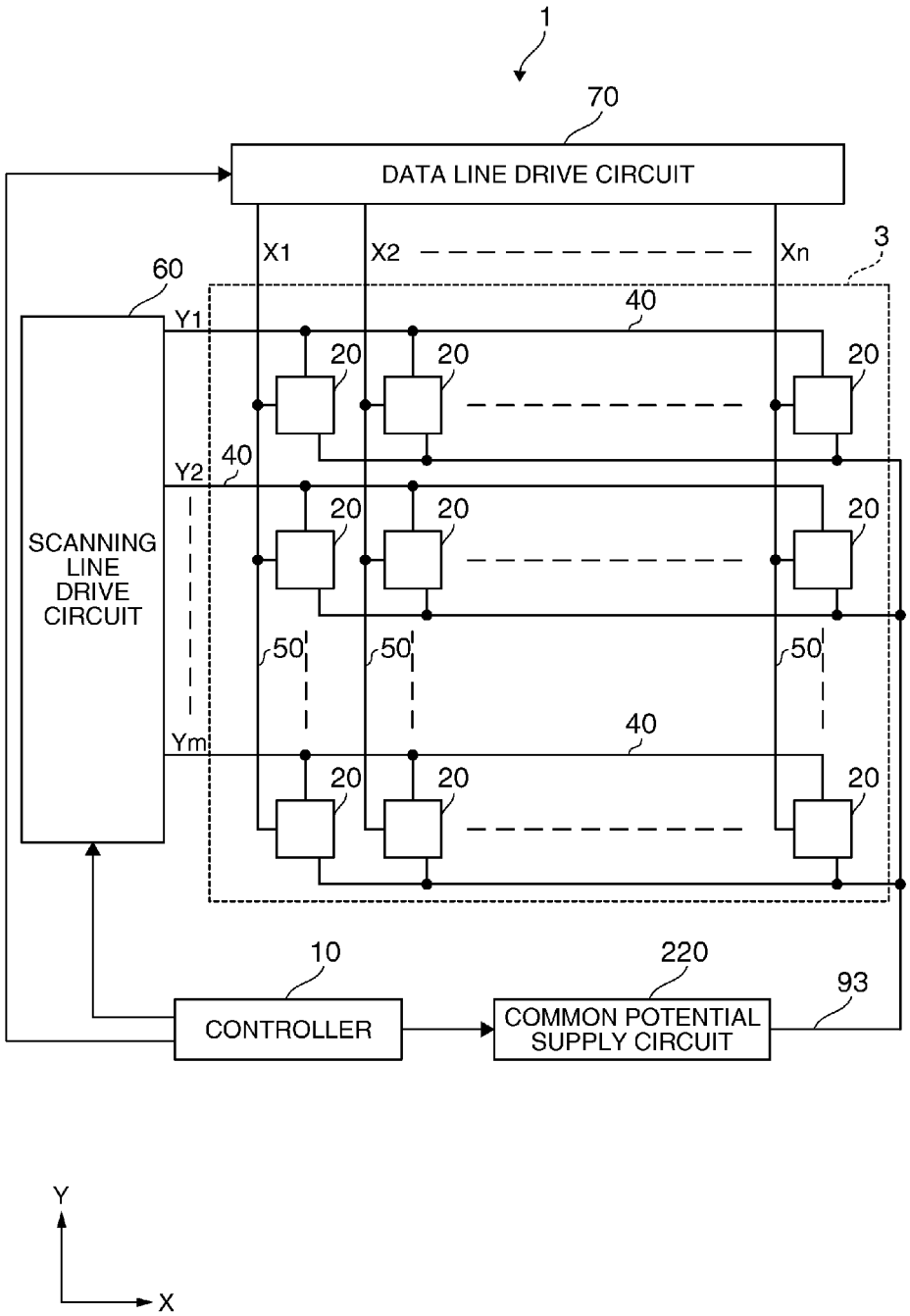
FIG. 2 is a block diagram showing a configuration around a display section of the electrophoretic display device in accordance with the embodiment.

FIG. 2 is a block diagram showing a configuration around the display section of the electrophoretic display device in accordance with the embodiment.

In FIG. 2, the electrophoretic display device 1 in accordance with the present embodiment is an electrophoretic display device of an active matrix drive type, and has a display section 3, a controller 10, a scanning line drive circuit 60, a data line drive circuit 70, and a common potential supply circuit 220.

In the display section 3, m rows x n columns of pixels 20 are arranged in a matrix (in a two-dimensional plane). Also, on the display section 3, m scanning lines 40 (that is, scanning lines Y1, Y2, . . . and Ym), and n data lines 50 (that is, data lines X1, X2, . . . and Xn) are arranged in a manner to intersect one another. Concretely, the m scanning lines 40 extend in a row direction (i.e., X direction), and the n data lines 50 extend in a column direction (i.e., Y direction). Pixels 20 are disposed at positions corresponding to intersections between the m scanning lines 40 and the n data lines 50.

The controller 10 controls the operation of the scanning line drive circuit 60, the data line drive circuit 70, and the common potential supply circuit 220. The controller 10 supplies timing signals, such as, for example, a clock signal, a start pulse, etc., to each of the circuits.

The scanning line drive circuit 60 sequentially supplies a scanning signal in pulses to each of the scanning lines Y1, Y2, . . . , Ym during a predetermined frame period under the control of the controller 10.

The data line drive circuit 70 supplies data potentials to the data lines X1, X2, . . . , and Xn under the control of the controller 10. The data potential assumes a standard potential GND (for example, 0 volt), a high potential VSH (for example, +15 volt) or a low potential −VSH (for example, −15 volt).

The common potential supply circuit 220 supplies a common potential Vcom (in the embodiment, the same potential as the reference potential GND) to the common potential line 93. Note that the common potential Vcom may be a potential different from the reference potential GND within the range where a voltage is not substantially generated between the counter electrode 22 to which the common potential Vcom is supplied and the pixel electrode 21 to which the reference potential GND is supplied. For example, the common potential Vcom may assume a value different from the reference potential GND supplied to the pixel electrode 21, in consideration of changes in the potential of the pixel electrode 21 due to feedthrough, and even in this case, the common potential Vcom and the reference potential GND are considered to be the same in the present specification.

After the scanning signal is supplied to the scanning lines 40, and potentials are supplied to the pixel electrodes 21 through the data lines 50, and then when the supply of the scanning signal to the scanning lines 40 ends (for example, when the potential on the scanning lines 40 decreases), the potential on the pixel electrodes 21 may fluctuate (for example, decrease with the lowering potential on the scanning lines 40) due to the parasitic capacitance between the scanning lines 40. This phenomenon is called feedthrough. Assuming in advance that the potential on the pixel electrode 21 would lower due to feedthrough, the common potential Vcom may be set to a value slightly lower than the reference potential GND to be supplied to the pixel electrode 21. Even in this case, the common potential Vcom and the reference potential GND are considered to be the same potential.

Though various signals are input to and output from the controller 10, the scanning line drive circuit 60, the data line drive circuit 70, and the common potential supply circuit 220, the explanation for signals irrelevant to the present embodiment is omitted.

Figure 3:
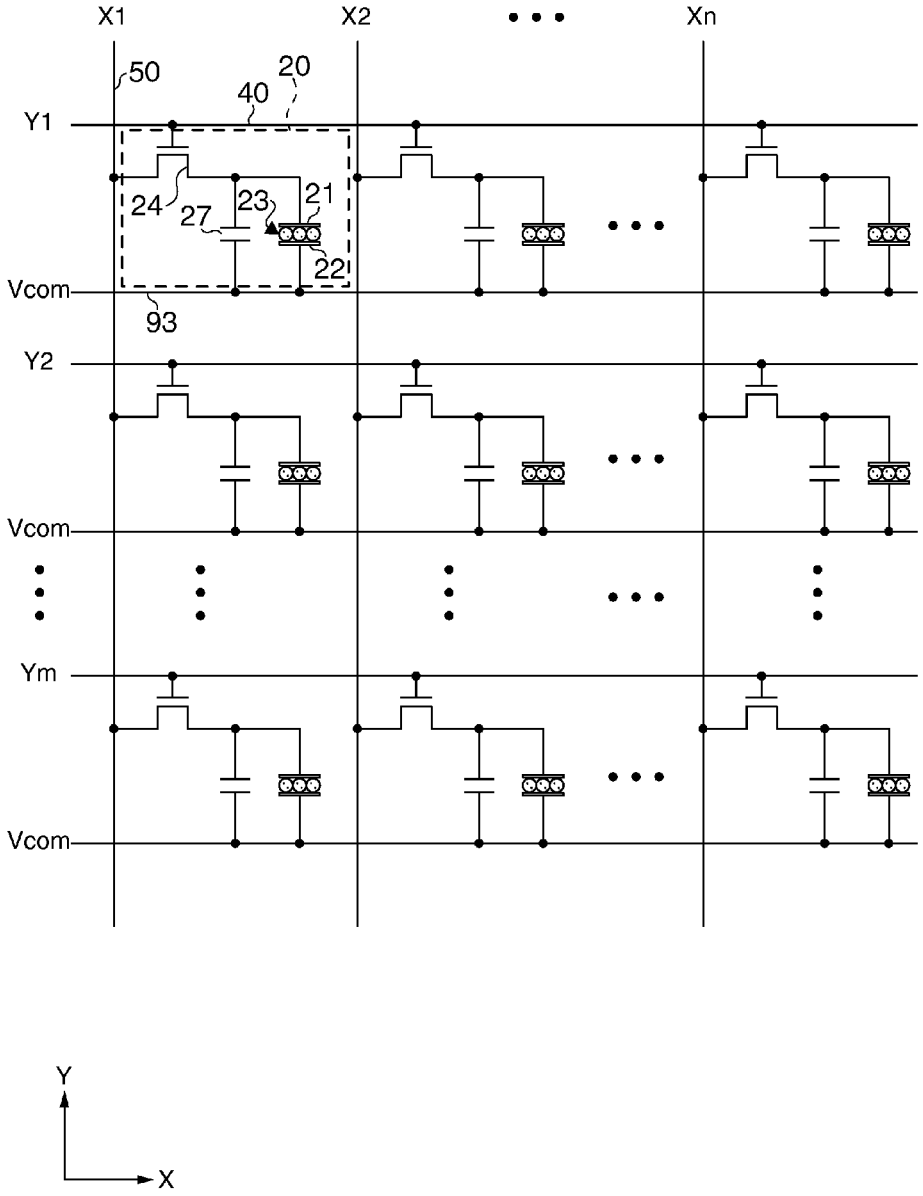
FIG. 3 is an equivalent circuit diagram showing an electrical configuration of pixels in accordance with an embodiment.

FIG. 3 is an equivalent circuit diagram of the electrical configuration of pixels in accordance with the present embodiment.

As shown in FIG. 3, the pixel 20 is equipped with a pixel switching transistor 24, a pixel electrode 21, a counter electrode 22, an electrophoretic element 23, and a retention capacitance 27.

The pixel switching transistor 24 is formed from, for example, an N type transistor. The pixel switching transistor 24 has a gate electrically connected with the scanning line 40, a source electrically connected with the data line 50, and a drain electrically connected with the pixel electrode 21 and the retention capacitance 27. The pixel switching transistor 24 outputs data potential supplied from the data line drive circuit 70 (see FIG. 2) through the data line 50 to the pixel electrode 21 and the retention capacitor 27 with a timing corresponding to the scanning signal in pulses supplied through the scanning line 40 from the scanning line drive circuit 60 (see FIG. 2).

The data potential is supplied to the pixel electrode 21 from the data line drive circuit 70 through the data line 50 and the pixel switching transistor 24. The pixel electrode 21 is arranged in a manner facing the counter electrode 22 through the electrophoretic element 23.

The counter electrode 22 is electrically connected to the common potential line 93 to which the common potential Vcom is supplied.

The electrophoretic element 23 is formed from a plurality of microcapsules each containing electrophoretic particles.

The retention capacitance 27 is formed from a pair of electrodes arranged opposite each other through a dielectric film. One of the electrodes is electrically connected with the pixel electrode 21 and the pixel switching transistor 24, and the other electrode is electrically connected with the common potential line 93. The data potential can be retained only for a certain period by the retention capacitance 27.

Next, a concrete configuration of the display section of the electrophoretic display device in accordance with the present embodiment will be described referring to FIG. 4.

Figure 4:
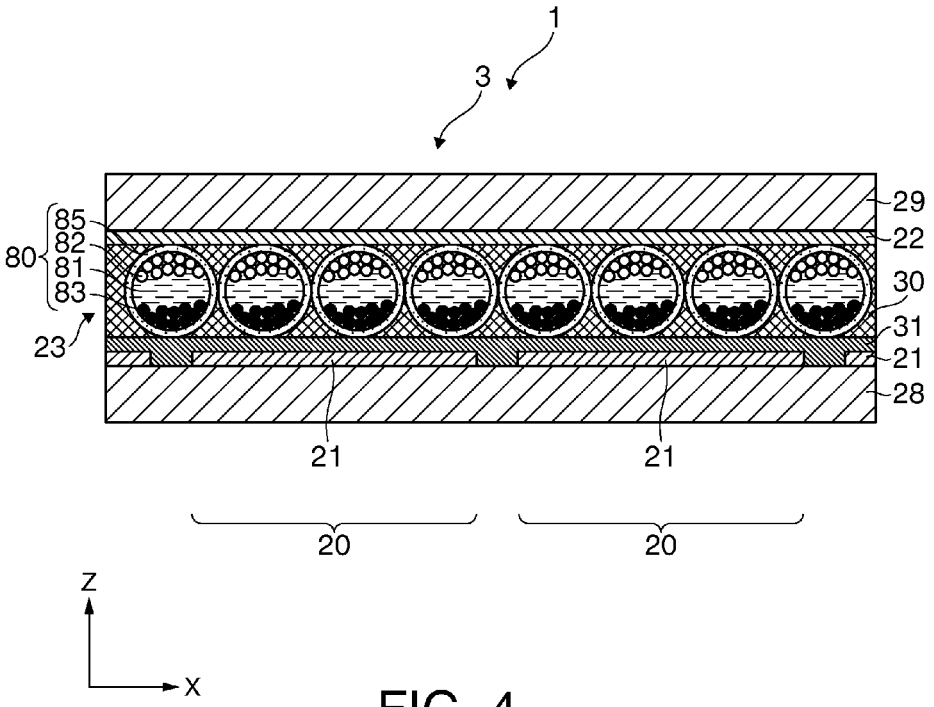
FIG. 4 is a cross-sectional view in part of the display section of the electrophoretic display device in accordance with the embodiment.

FIG. 4 is a cross-sectional view in part of the display section 3 of the electrophoretic display device 1 in accordance with the present embodiment.

In FIG. 4, the display section 3 is configured such that the electrophoretic element 23 is held between the element substrate 28 and the counter substrate 29. The embodiment is described assuming that an image is displayed on the side of the counter substrate 29.

The element substrate 28 is made of glass or plastic material, for example. A laminated structure in which the pixel switching transistor 24, the retention capacitance 27, the scanning lines 40, the data lines 50 and the common potential line 93 described above with reference to FIG. 2, though their illustration is omitted here, are formed on the element substrate 28. The plural pixel electrodes 21 are arranged on the upper layer side of the laminated structure in a matrix configuration.

The counter substrate 29 is a transparent substrate made of, for example, glass, plastics or the like. On an opposing surface of the counter substrate 29 facing the element substrate 28, a counter electrode 22 is formed solidly, opposite the plural pixel electrodes 21. The counter electrode 22 is made of a transparent conductive material, such as, for example, magnesium silver (MgAg), indium tin oxide (ITO), indium zinc oxide (IZO), or the like.

The electrophoretic element 23 is made up of a plurality of microcapsules 80 each containing electrophoretic particles. The electrophoretic element 23 is fixed between the element substrate 28 and the counter substrate 29 by means of a binder 30 made of a resin or the like and an adhesive layer 31. Note that the electrophoretic display device 1 is structured, in the manufacturing process, with an electrophoretic sheet having the electrophoretic element 23 affixed in advance to the side of the counter substrate 29 with the binder 30 bonded to the element substrate 28 which is independently fabricated and has the pixel electrodes 21 and the like with the adhesive layer 31.

One or a plurality of microcapsules 80 are disposed in each of the pixels 20 (in other words, for each of the pixel electrodes 21) and sandwiched between the pixel electrode 21 and the counter electrode 22.

The microcapsule 80 includes a dispersion medium 81, a plurality of white particles 82 and a plurality of black particles 83 contained in a membrane 85. The microcapsule 80 is formed in a spherical body having a grain diameter of, for example, about 50 μm.

The membrane 85 functions as an outer shell of the microcapsule 80, and may be formed from acrylic resin such as polymethyl methacrylate and polyethyl methacrylate, or polymer resin having translucency such as urea resin, gum Arabic and gelatin.

The dispersion medium 81 is a solvent in which the white particles 82 and black particles 83 are dispersed in the microcapsule 80 (in other words, within the membrane 85). As the dispersion medium 81, water; alcohol solvents (such as, methanol, ethanol, isopropanol, butanol, octanol, and methyl cellosolve); esters (such as, ethyl acetate, and butyl acetate); ketones (such as, acetone, methyl ethyl ketone, and methyl isobutyl ketone); aliphatic hydrocarbons (such as, pentane, hexane, and octane); alicyclic hydrocarbons (such as, cyclohexane and methylcyclohexane); aromatic hydrocarbons (such as, benzene, toluene, benzenes having a long-chain alkyl group (such as, xylene, hexylbenzene, butylbenzene, octylbenzene, nonylbenzene, decylbenzene, undecylbenzene, dodecylbenzene, tridecylbenzene, and tetradecylbenzene)); halogenated hydrocarbons (such as, methylene chloride, chloroform, carbon tetrachloride, and 1,2-dichloroethane); carboxylates, and any one of other various oils may be used alone or in combination, and may be further mixed with a surfactant.

The white particles 82 are particles (polymer or colloid) made of white pigment, such as, for example, titanium dioxide, flowers of zinc (zinc oxide), antimony oxide, or the like, and may be negatively charged, for example.

The black particles 83 are particles (polymer or colloid) made of black pigment, such as, for example, aniline black, carbon black or the like, and may be positively charged, for example.

Accordingly, the white particles 82 and the black particles 83 can move in the dispersion medium 81 by an electric field generated by a potential difference between the pixel electrode 21 and the counter electrode 22.

A charge-controlling agent made of particles, such as, electrolytes, surfactant, metal soap, resin, rubber, oil, varnish or compound, a dispersing agent, such as, a titanium coupling agent, an aluminum coupling agent, a silane coupling agent, or the like, lubricant, stabilizing agent, and the like may be added to the aforementioned pigment as necessary.

As shown in FIG. 4, when a voltage is applied between the pixel electrode 21 and the counter electrode 22 to set the potential on the counter electrode 22 to be relatively higher than the other, the positively charged black particles 83 are drawn to the side of the pixel electrode 21 within the microcapsules 80 by a Coulomb force, and the negatively charged white particles 82 are drawn to the side of the counter electrode 22 within the microcapsules 80 by a Coulomb force. As a result, the white particles 82 gather on the side of the display surface (in other words, on the side of the counter electrode 22) within the microcapsules 80, whereby the color of the white particles 82 (i.e., white) is displayed at the display surface of the left screen 110. On the other hand, when a voltage is applied between the pixel electrode 21 and the counter electrode 22 to set the potential on the pixel electrode 21 to be relatively higher than the other, the negatively charged white particles 82 are drawn to the side of the pixel electrode 21 within the microcapsules 80 by a Coulomb force, and the positively charged black particles 83 are drawn to the side of the counter electrode 22 within the microcapsules 80 by a Coulomb force. As a result, the black particles 83 gather on the side of the display surface within the microcapsules 80, whereby the color of the black particles (i.e., black) is displayed at the display surface of the left screen 110.

Note that the pigment used for the white particles 82 or the black particles 83 may be replaced with other pigment of different color, such as, red, green, blue or the like, whereby red color, green color, blue color or the like can be displayed.

Next, referring to FIG. 5 and FIG. 6, the characteristic of the display section 3 of the electrophoretic display device 1 in accordance with the present embodiment will be described. In the following section, an example in which the electrophoretic display device 1 in accordance with the present embodiment is capable of displaying gray levels in eight stages will be described. In this example, it is assumed that the gray level corresponding to black is level 0, the gray level corresponding to white is level 7, and intermediate gray levels between black and white are shown by level 1 through level 6, respectively. The "gray level" referred here is one example of an "optical state" in the invention, and may be paraphrased as, for example, brightness or reflectivity.

Figure 5:
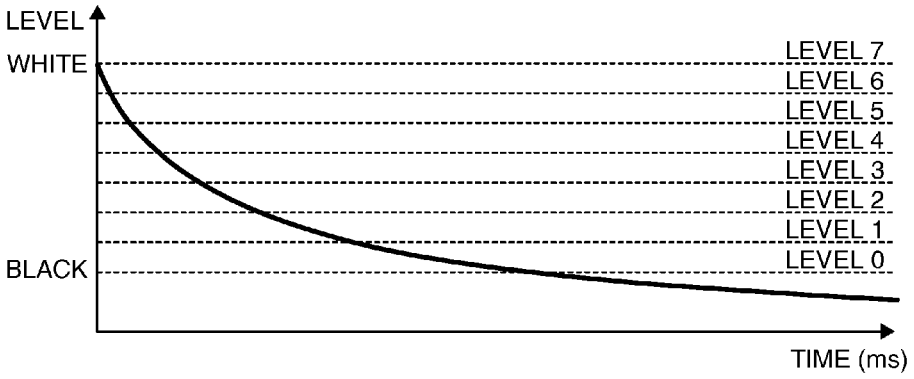
FIG. 5 is a graph showing changes in the gray levels when rewriting white color to black color.

FIG. 5 is a graph showing changes in the gray level when it is rewritten from white to black.

In FIG. 5, when an image is rewritten from white to black, the change in the gray level with respect to the period in which the voltage is impressed tends to become smaller as it approaches an opposite gray level, though it is large immediately after the beginning of rewriting. In other words, the gray level greatly changes when it is close to white, but the gray level becomes more difficult to change as it approaches black.

Figure 6:
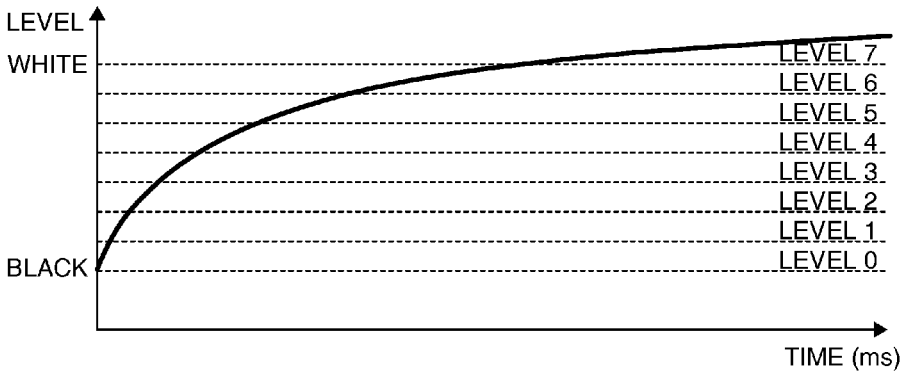
FIG. 6 is a graph showing changes in the gray levels when rewriting black color to white color.

FIG. 6 is a graph showing changes in the gray levels when it is rewritten from black to white.

In FIG. 6, when an image is rewritten from black to white, similarly, the change in the gray levels with respect to the period in which the voltage is impressed tends to become smaller as it approaches an opposite gray level, though it is large immediately after the beginning of rewriting. In other words, the gray level greatly changes when it is close to black, but the gray level becomes more difficult to change as it approaches white.

In this manner, the display section 3 has a nonlinear characteristic in which the gray level change rate to the period of impressing the drive voltage changes. Therefore, even if the drive voltage is simply impressed only for the period corresponding to the change rate of the gray level, it is difficult to achieve the desired gray level. Therefore, in the present embodiment, the target gray level is achieved by a plurality of phases of impressing voltages of different polarities.

In the following section, an image rewriting operation by the electrophoretic display device 1 in accordance with the present embodiment will be described with reference to FIG. 7 through FIG. 9. Note that, in FIGS. 7 through 9, the period for keeping the DC balance ratio characteristic to the present embodiment (phase P and phase N to be described later) is omitted for convenience of description.

Figure 7:
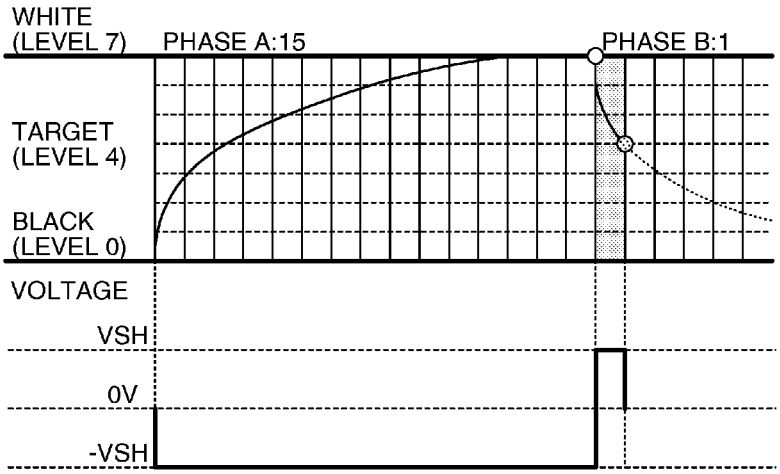
FIG. 7 is an illustration showing a concept of a voltage application method when an intermediate gray level 4 is displayed.

FIG. 7 is an illustration showing a concept of a voltage application method when an intermediate gray level 4 is displayed.

In FIG. 7, it is assumed that the gray level before rewriting is level 0 (that is, black), and the gray level after rewriting (hereafter called a "target gray level" if appropriate) is an intermediate gray level 4. Note that the target gray level is one example of the "first optical state" in the invention.

In this case, the drive voltage −VSH corresponding to white is first impressed in Phase A to the pixel to be rewritten by 15 frames. As a result, the displayed gray level assumes level 7 (that is, white).

Phase A is set as a period in which the drive voltage −VSH corresponding to white will be impressed long enough until the gray level displayed so far becomes white. Note that Phase A can be omitted when it is judged that white is displayed in the pixel to be rewritten.

According to Phase A, before the intermediate gray level, that is the target gray level, is achieved, the white color is once displayed, whereby the positions of the white particles 82 and the black particles 83 which may vary among the pixels can be made uniform. Therefore, it is possible to prevent generation of deviations in the gray level to be displayed, which originates from the fact that differences are generated in the positions of the particles in each pixel when the intermediate gray level is displayed. Phase A is one example of the "first control step" in the invention.

In succession, the drive voltage VSH corresponding to black is impressed by one frame in Phase B. As a result, the displayed gray level assumes level 4, whereby the target gray level is achieved.

Phase B is a period in which the drive voltage VSH corresponding to the black (that is, the potential of a reverse-polarity with respect to Phase A) is impressed to the pixel to be rewritten. By setting Phase B in a relatively short span of time (in other words, a period to the extent that the displayed gray level does not reach black), a gray color that is an intermediate gray level between white and black can be achieved. In the electrophoretic display device 1 in accordance with the present embodiment, a plurality of intermediate gray levels can be displayed by adjusting the period of Phase B. In other words, light gray close to white, dark gray close to black, etc. can be displayed. Phase B is one example of the "second control step" in the invention.

According to the research conducted by the inventor, it has been discovered that there are cases where, when the gray level is changed from white to an intermediate gray level, the target gray level cannot be achieved only by Phase B, due to the nonlinear characteristic of the electrophoretic element 23 described above. In the following section, the gray level that cannot be achieved only by Phase B will be described.

Figure 8:
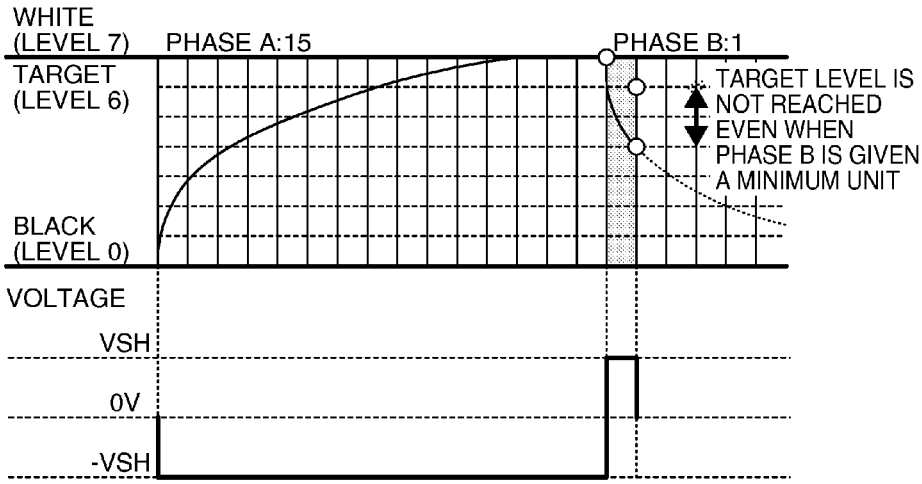
FIG. 8 is an illustration showing a concept of a voltage application method when an intermediate gray level 6 is displayed only with Phase A and Phase B.

FIG. 8 is an illustration showing a concept of a voltage application method when an intermediate gray level 6 is displayed only with Phase A and Phase B.

In FIG. 8, it is assumed that the gray level before rewriting is level 0 (that is, black), and the target gray level is an intermediate gray level 6. In this case, the drive voltage −VSH corresponding to white is first impressed in Phase A to the pixel to be rewritten by 15 frames. As a result, the displayed gray level assumes level 7 (that is, white).

Then, the drive voltage VSH corresponding to black is impressed by one frame in Phase B. However, the displayed gray level after Phase B becomes level 4, similarly to the case of FIG. 7, and the target gray level 6 is not achieved. In other words, the gray level changes greatly due to the characteristic of the electrophoretic element 23 even if the voltage VSH is impressed only by one frame that is a minimum unit of the period of voltage impression, and the target gray level cannot be achieved.

Though an intermediate gray level that is relatively away from white such as level 4 can be achieved only by Phase B as described above, it might be difficult to achieve an intermediate gray level relatively close to white such as level 6 only by Phase B. In contrast, the gray level is fine-tuned by executing Phase C after Phase B in the present embodiment. Rewriting of an image that uses Phase C will be described below. FIG. 9 is an illustration showing a concept of a voltage application method when the intermediate gray level 6 is displayed by using Phase C.

Figure 9:
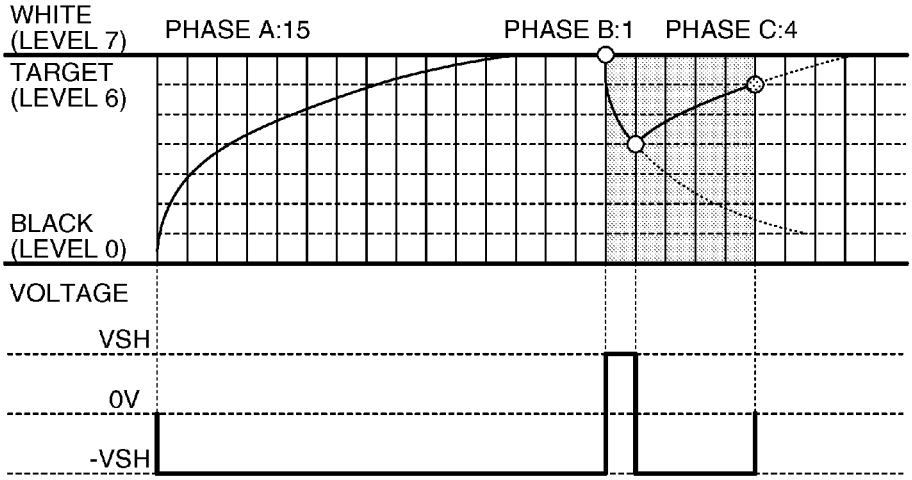
FIG. 9 is an illustration showing a concept of a voltage application method when an intermediate gray level 6 is displayed using Phase C.

In FIG. 9, Phase C is one example of the "fifth control step" in the invention, and is a period set to bring the gray level, that has become close to black more than the target gray level by the voltage impression in Phase B, close to the target gray level. In phase C, the drive voltage VSH corresponding to white (that is, the voltage of the same polarity as that of Phase A) is impressed to the pixel for rewriting.

Concretely, Phase C is set as a period to bring the gray level that has become level 4 by Phase B (that is, the gray level that is close to black more than the target gray level) to level 6 that is the target gray level. Because the drive voltage VSH corresponding to white is impressed in Phase C, the gray level is brought close to white. In this case, the change rate of the gray level becomes small, as shown in FIG. 6, compared with Phase B in which the change rate is relatively large. In other words, the gray level changes more gently in Phase C compared with Phase B. Therefore, by impressing the drive voltage VSH by four frames in Phase C, the intermediate gray level, that is level 4, can be brought to level 6 that is the target gray level.

In this manner, by using Phase C, the gray level that would not be achieved only by Phase B can suitably be achieved.

However, as described above, when voltages of different polarities are alternately impressed to perform rewriting, bias might be generated in the polarities of the voltages impressed to the pixels, in the overall rewriting process. Concretely, for example, a difference may be generated between the period in which the voltage of a polarity corresponding to white is impressed and the period in which the voltage of a polarity corresponding to black is impressed.

According to the research conducted by the inventor, it has become clear that, if bias in the polarities described above is generated, troubles such as image burn-in, deterioration of the display section, and the like are caused. To prevent such troubles, in accordance with the present embodiment, Phase P and Phase N to keep the DC balance ratio are executed, before Phase A, Phase B, and Phase C described above.

A method of setting Phase P and Phase N will be described below with reference to FIG. 10 and FIG. 11.

Figure 10:
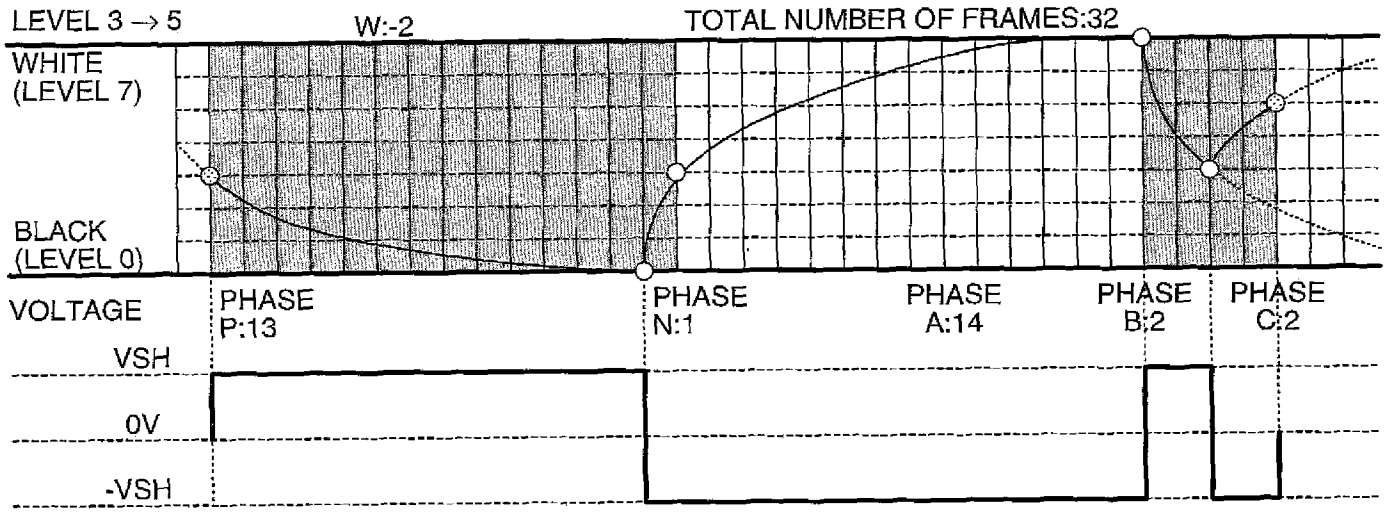
FIG. 10 is an illustration showing a concept of a voltage application method when an intermediate gray level 3 is rewritten to an intermediate gray level 5.

FIG. 10 is an illustration showing a concept of a voltage application method when an intermediate gray level 3 is rewritten to an intermediate gray level 5.

In FIG. 10, Phase P is set as a period to impress the drive voltage VSH corresponding to black. More specifically, in Phase P, the voltage of the same polarity as that of the voltage impressed by Phase B is impressed. Further, Phase N is set as a period to impress the drive voltage −VSH corresponding to white after Phase P. More specifically, in Phase N, the voltage of the same polarity as that of the voltage impressed by Phase A and Phase C is impressed. Note that Phase P is one example of the "third control step" in the invention, and Phase N is one example of the "fourth control step" in the invention.

It is desirable that the gray level before the beginning of Phase P (in other words, before the beginning of rewriting) is equal to the gray level after the end of Phase N (in other words, immediately before the beginning of Phase A). For example, in the case shown in FIG. 10, both of the gray level before the beginning of Phase P and the gray level after the end of Phase N are assumed to be level 3. As a result, each of the periods of Phase A, Phase B and Phase C that substantially form the rewriting period can be set without depending on the period of Phase P and Phase N.

In accordance with an aspect of the embodiment, each of the periods of Phase P and Phase N is set based on an integrated value of the drive voltage to be impressed at the time of rewriting and the drive time (hereafter, also simply referred to as an "integrated value"). Concretely, they are set such that the relation between an integrated value W (A→B) when an arbitrary gray level A is rewritten to a gray level B, and an integrated value W (B→A) when the gray level B is rewritten to the gray level A satisfies Expression (1) as follows.

$$W(A \rightarrow B) = -W(B \rightarrow A) \tag{1}$$

In other words, the periods of Phase P and Phase N are set such that the integrated values when rewriting in opposite directions have the same absolute values though their signs (positive and negative) are mutually different.

Assuming that the frame period of Phase A is AF, the frame period of Phase B is BF, the frame period of Phase C is CF, the frame period of Phase P is PF, and the frame period of Phase N is NF, the integrated value W (A→B) may be obtained by Expression (2) as follows.

$$W(A \rightarrow B) = VSH \times (-AF + BF - CF + PF - NF) \tag{2}$$

Here, as shown in FIG. 10 when the intermediate gray level 3 is written to the intermediate gray level 5, Phase P is set to 13 frames, Phase N is set to 1 frame, Phase A is set to 14 frames, Phase B is set to 2 frames, and Phase C is set to 2 frames, respectively. Accordingly, the integrated value W (3→5) in this case is obtained by Expression (3) as follows.

$$W(3 \rightarrow 5) = VSH \times (-14 + 2 - 2 + 13 - 1) = -2VSH \tag{3}$$

Figure 11:
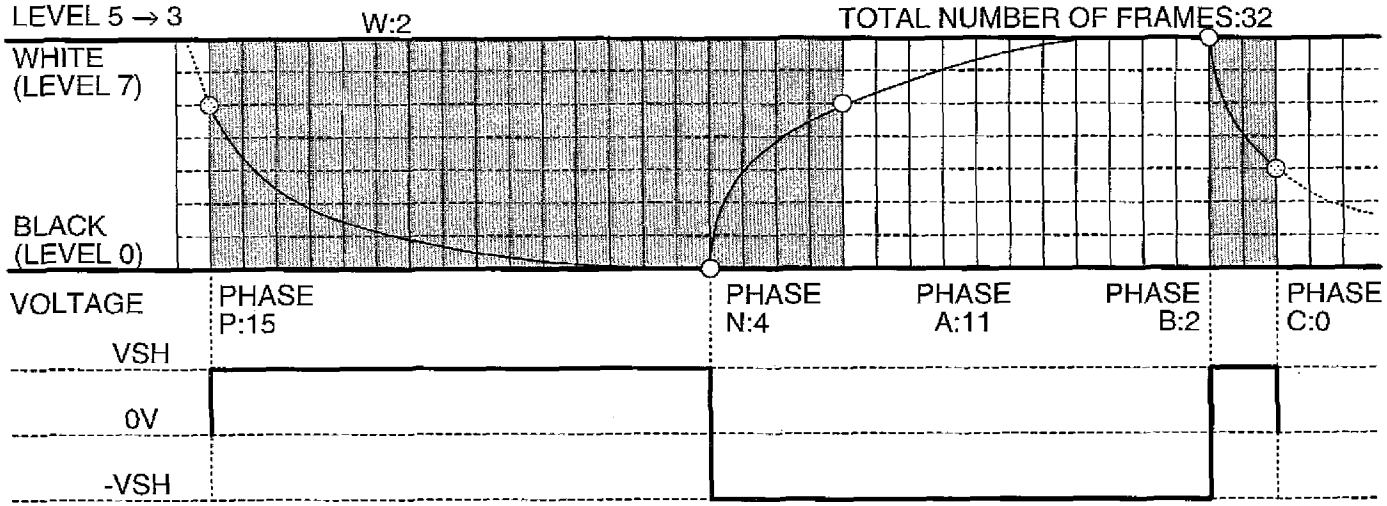
FIG. 11 is an illustration showing a concept of a voltage application method when an intermediate gray level 5 is rewritten to an intermediate gray level 3.

FIG. 11 is an illustration showing a concept of a voltage application method when an intermediate gray level 5 is rewritten to an intermediate gray level 3.

In FIG. 11, as the integrated value W(5→3) is −2VSH, the integrated value W(3→5) when rewriting in the opposite direction only has to become 2VSH. To satisfy this relation, Phase P is set to 15 frames, Phase N is set to 4 frame, Phase A is set to 11 frames, Phase B is set to 2 frames, and Phase C is set to 0 frames, respectively. Accordingly, the integrated value W (5→3) in this case is obtained by Expression (4) as follows.

$$W(5 \rightarrow 3) = VSH \times (-11 + 2 - 0 + 15 - 4) = 2VSH \tag{4}$$

When the relation W(A→B)=−W(B→A) is satisfied in this manner, bias can be prevented from being generated in the polarities of the voltages impressed to the rewriting pixels. Therefore, collapsing of the DC balance ratio can be suppressed, and troubles such as image burn-in, deterioration of the display section and the like can be effectively prevented.

Note that it is extremely difficult to achieve the relation of W(A→B)=−W(B→A) only by Phase A, Phase B and Phase C due to the nonlinear characteristic described above with reference to FIG. 5 and FIG. 6. In contrast, in accordance with the present embodiment, because Phase P and Phase N are performed before Phase A, Phase B and Phase C, the relation of W(A→B)=−W(B→A) can be suitably achieved by adjusting each period of Phase P and Phase N.

Note that the period of each Phase can be readily set by using a predetermined weight table. In the following section, a method of setting the period of each Phase using a weight table will be described with reference to FIGS. 12-18.

FIG. 12 is a table figure showing one example of a weight table.

As shown in FIG. 12, the weight table has weight values WHT corresponding respectively to the gray levels from 0 to 7. Each of the weight values WHT is a value corresponding to an integrated value of the drive voltage and the drive time when rewriting an image described above. Concretely, the period of each phase is set such that a sign reversed value, in which the positive/negative sign of a value obtained by subtracting the weight value WHT corresponding to the gray level before rewriting from the weight value WHT corresponding to the target gray level, becomes an integrated value of the drive voltage and the drive time in actual rewriting.

The weight value WHT is set as a value that increases monotonously with respect to the gray level. As a result, the relation of W(A→B)=−W(B→A) described above can be suitably achieved. Note that the weight value WHT may be set as a value that decreases monotonously with respect to the gray level. Alternatively, it may be set as a value proportional to the gray level.

Figure 13:
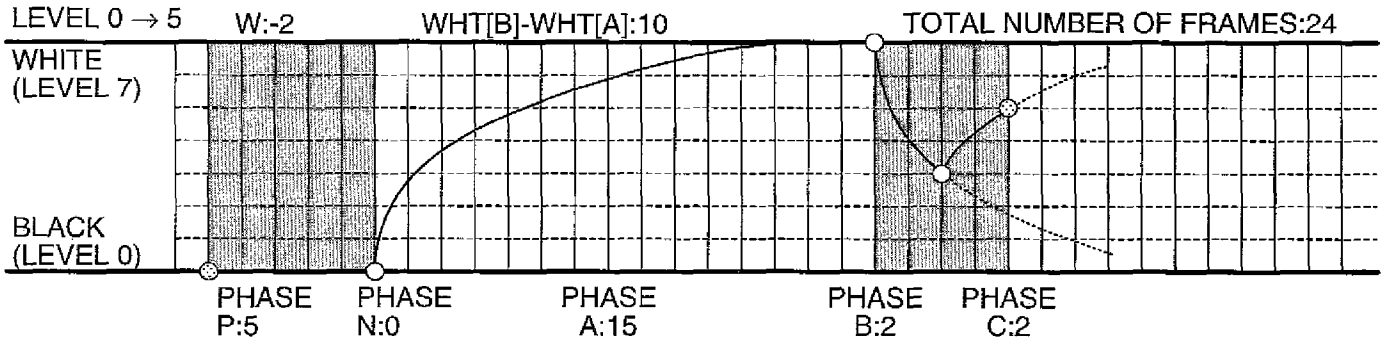
FIG. 13 is an illustration showing a concept of a voltage application method when a gray level 0 is rewritten to an intermediate gray level 5.

FIG. 13 is an illustration showing a concept of a voltage application method when a gray level 0 is rewritten to an intermediate gray level 5.

In FIG. 13, when the gray level 0 is rewritten to the intermediate gray level 5, first, the difference between the weight value WHT(5) corresponding to level 5 that is the target gray level and the weight value WHT(0) corresponding to level 0 that is the gray level before rewriting is obtained. Here, in the table shown in FIG. 12, WHT(5)=10 and WHT(0)=0. Therefore, the difference in weight value between the target gray level and the gray level before rewriting is "10." Accordingly, the period of each phase is set such that the integrated value W(0→5) when the gray level 0 is rewritten to the intermediate gray level 5 becomes to be "−10." As a result, Phase P is set to 5 frames, Phase N is set to 0 frame, Phase A is set to 15 frames, Phase B is set to 2 frames, and Phase C is set to 2 frames.

Figure 14:
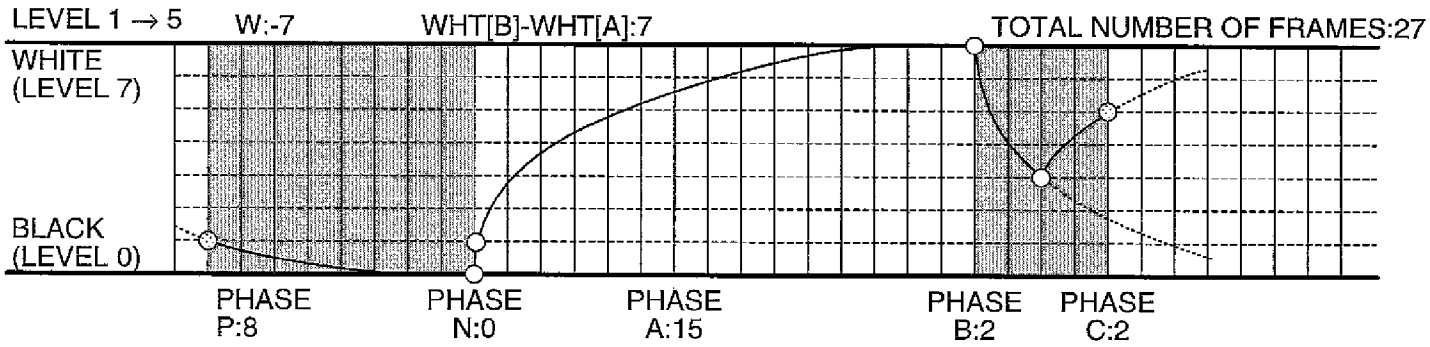
FIG. 14 is an illustration showing a concept of a voltage application method when an intermediate gray level 1 is rewritten to an intermediate gray level 5.

FIG. 14 is an illustration showing a concept of a voltage application method when an intermediate gray level 1 is rewritten to an intermediate gray level 5.

In FIG. 14, when the gray level 1 is rewritten to the intermediate gray level 5, first, the difference between the weight value WHT(5) corresponding to level 5 that is the target gray level and the weight value WHT(1) corresponding to level 1 that is the gray level before rewriting is obtained. Here, in the table shown in FIG. 12, WHT(5)=10 and WHT(1)=3. Therefore, the difference in weight value between the target gray level and the gray level before rewriting is "7." Accordingly, the period of each phase is set such that the integrated value W(1→5) when the intermediate gray level 1 is rewritten to the intermediate gray level 5 becomes to be "−7." As a result, Phase P is set to 8 frames, Phase N is set to 0 frame, Phase A is set to 15 frames, Phase B is set to 2 frames, and Phase C is set to 2 frames.

Figure 15:
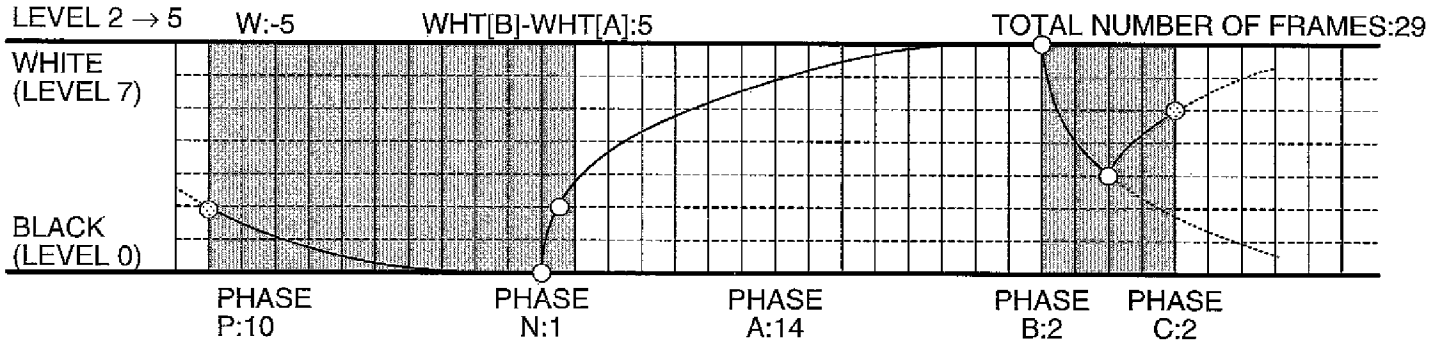
FIG. 15 is an illustration showing a concept of a voltage application method when an intermediate gray level 2 is rewritten to an intermediate gray level 5.

FIG. 15 is an illustration showing a concept of a voltage application method when an intermediate gray level 2 is rewritten to an intermediate gray level 5.

In FIG. 15, when the gray level 2 is rewritten to the intermediate gray level 5, first, the difference between the weight value WHT(5) corresponding to level 5 that is the target gray level and the weight value WHT(2) corresponding to level 2 that is the gray level before rewriting is obtained. Here, in the table shown in FIG. 12, WHT(5)=10 and WHT(2)=5. Therefore, the difference in weight value between the target gray level and the gray level before rewriting is "5." Accordingly, the period of each phase is set such that the integrated value W(2→5) when the intermediate gray level 2 is rewritten to the intermediate gray level 5 becomes to be "−5." As a result, Phase P is set to 10 frames, Phase N is set to 1 frame, Phase A is set to 14 frames, Phase B is set to 2 frames, and Phase C is set to 2 frames.

Figure 16:
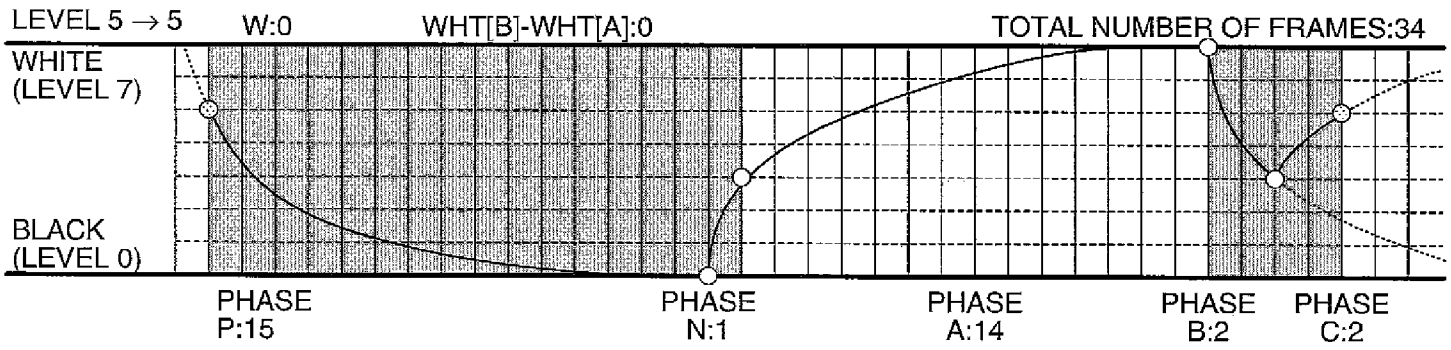
FIG. 16 is an illustration showing a concept of a voltage application method when an intermediate gray level 5 is rewritten to an intermediate gray level 5.

FIG. 16 is an illustration showing a concept of a voltage application method when an intermediate gray level 5 is rewritten to an intermediate gray level 5.

In FIG. 16, when the gray level 5 is rewritten to the intermediate gray level 5, first, the difference between the weight value WHT(5) corresponding to level 5 that is the target gray level and the weight value WHT(5) corresponding to level 5 that is the gray level before rewriting is obtained. Here, when the target gray level and the gray level before rewriting are the same, it goes without saying that the difference in weight value WHT becomes "0." Accordingly, the period of each phase is set such that the integrated value W(5→5) when the intermediate gray level 5 is rewritten to the intermediate gray level 5 becomes to be "0." As a result, Phase P is set to 15 frames, Phase N is set to 1 frame, Phase A is set to 14 frames, Phase B is set to 2 frames, and Phase C is set to 2 frames.

Figure 17:
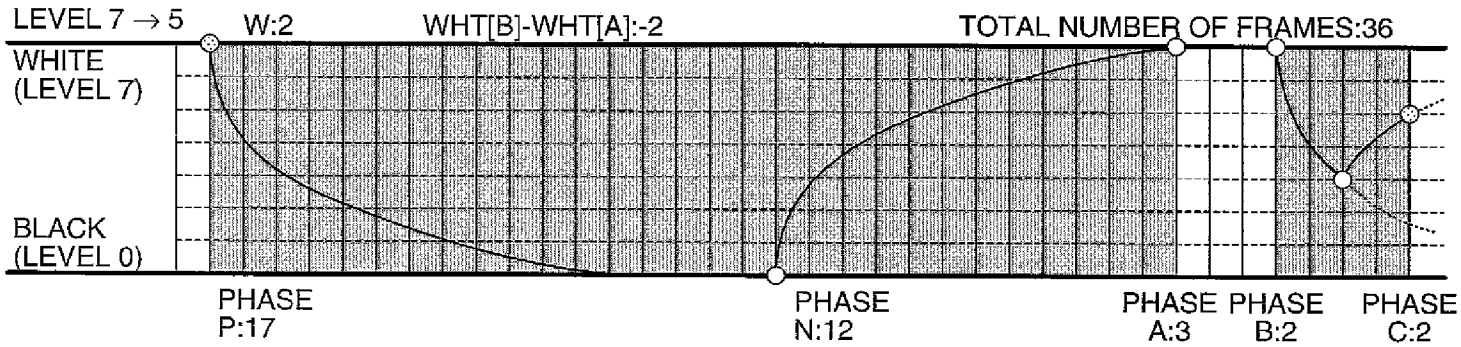
FIG. 17 is an illustration showing a concept of a voltage application method when a gray level 7 is rewritten to an intermediate gray level 5.

FIG. 17 is an illustration showing a concept of a voltage application method when a gray level 7 is rewritten to an intermediate gray level 5.

In FIG. 17, when the gray level 7 is rewritten to the intermediate gray level 5, the difference between the weight value WHT(5) corresponding to level 5 that is the target gray level and the weight value WHT(7) corresponding to level 7 that is the gray level before rewriting is obtained. Here, in the table shown in FIG. 12, WHT(5)=10 and WHT(7)=12. Therefore, the difference in weight value between the target gray level and the gray level before rewriting is "−2." Accordingly, the period of each phase is set such that the integrated value W(7→5) when the gray level 7 is rewritten to the intermediate gray level 5 becomes to be "2." As a result, Phase P is set to 17 frames, Phase N is set to 12 frame, Phase A is set to 3 frames, Phase B is set to 2 frames, and Phase C is set to 2 frames.

Figure 18:
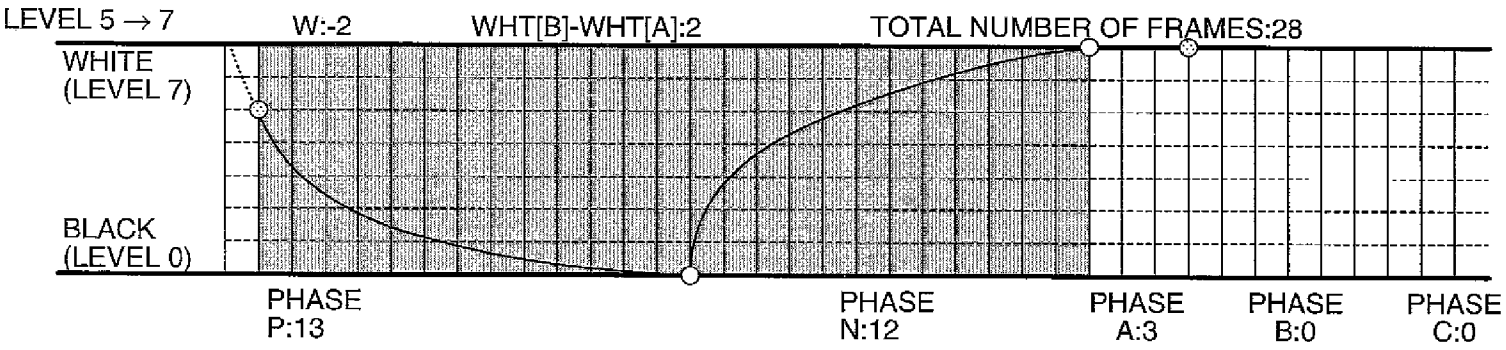
FIG. 18 is an illustration showing a concept of a voltage application method when an intermediate gray level 5 is rewritten to a gray level 7.

FIG. 18 is an illustration showing a concept of a voltage application method when an intermediate gray level 5 is rewritten to a gray level 7.

In FIG. 18, when the intermediate gray level 5 is rewritten to the gray level 7, the difference between the weight value WHT(7) corresponding to level 7 that is the target gray level and the weight value WHT(7) corresponding to level 5 that is the gray level before rewriting is obtained. Here, in the table shown in FIG. 12, WHT(7)=12 and WHT(5)=10. Therefore, the difference in weight value between the target gray level and the gray level before rewriting is "2." Accordingly, the period of each phase is set such that the integrated value W(5→7) when the intermediate gray level 5 is rewritten to the gray level 7 becomes to be "−2." As a result, Phase P is set to 13 frames, Phase N is set to 12 frame, Phase A is set to 3 frames, Phase B is set to 0 frames, and Phase C is set to 0 frames.

As is clear from the comparison between FIG. 17 and FIG. 18, the relation of W(A→B)=−W(B→A) is reliably achieved when the weight table is used. Therefore, collapsing of the DC balance ratio can be reliably suppressed.

As described above, according to the embodiment of the invention, while keeping the DC balance by Phase P and Phase N, a desired intermediate optical state can be suitably achieved by Phase A, Phase B and Phase C. As a result, a high-quality image can be displayed in the electro-optic device 1, while achieving high reliability.

In the embodiment described above, the voltage corresponding to white is impressed in Phase A, Phase C and Phase N, and the voltage corresponding to black is impressed in Phase B and phase P. However, the polarities may be mutually reversed. Specifically, the voltage corresponding to black may be impressed in Phase A, Phase C and Phase N, and the voltage corresponding to white may be impressed in Phase B and phase P.

Additionally, the gray level to be achieved in each phase may be selected to be either white or black. In other words, the gray level to be achieved in each phase may not be fixed to white or black, but white or black may properly selected according to the gray level before rewriting or the target gray level. As a result, intermediate gray levels can be more effectively displayed. However, it is required that the voltage impressed in Phase A and Phase C is in a reverse-polarity to the voltage impressed in Phase B. Similarly, it is required that the voltage impressed in Phase P is in a reverse-polarity to the voltage impressed in Phase N.

Furthermore, in the embodiments described above, an example is described in which the white particles 82 are negatively charged, and the black particles 83 are positively charged. However, the white particles 82 may be positively charged, and the black particles 83 may be negatively charged. Also, the electrophoretic element 23 is not limited to the configuration that has the microcapsules 80, and may have a configuration in which electrophoretic dispersion medium and electrophoretic particles are stored in spaces divided by partition walls. Though the electro-optic device having the electrophoretic element 23 is described as an electro-optic device, the invention is not limited to such a configuration. The electro -optic device may be one that uses, for example, electronic powder particles.

Electronic Apparatus

Next, electronic apparatuses using the above-described electrophoretic display device will be described with reference to FIGS. 19 and 20. Examples in which the above-described electrophoretic display device is applied to an electronic paper and an electronic notepad will be described.

Figure 19:
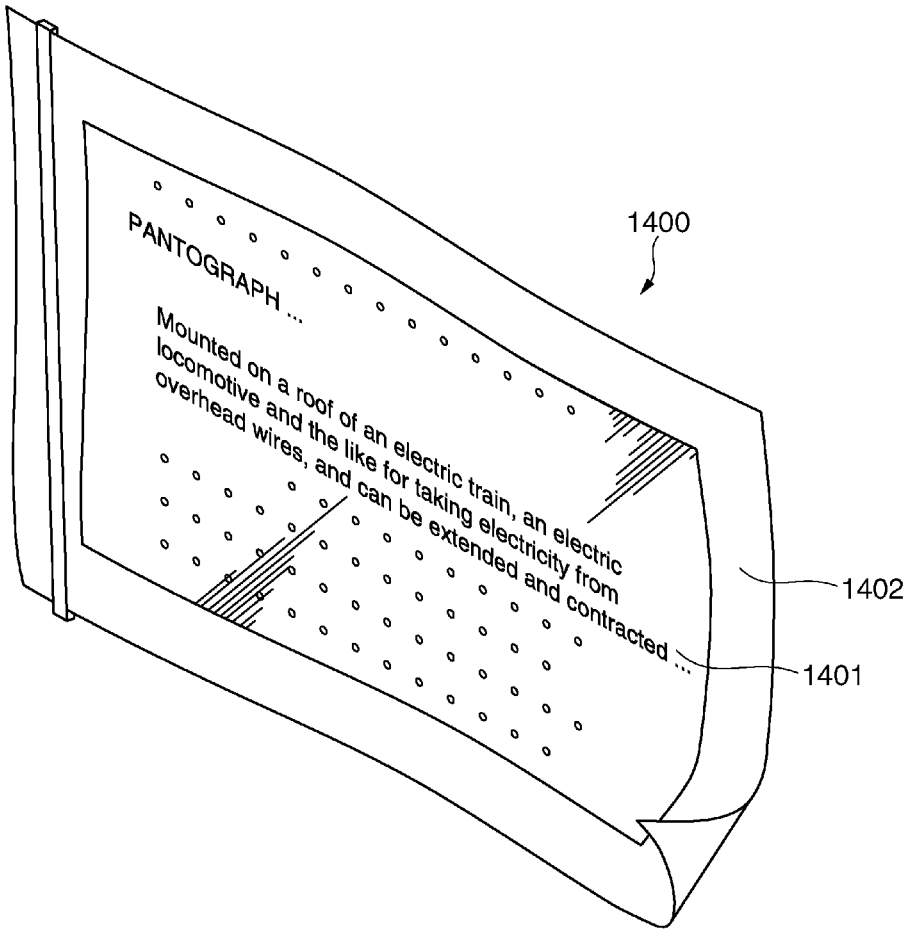
FIG. 19 is a perspective view showing a configuration of electronic paper that is an example of an electronic apparatus using the electro-optic device.

FIG. 19 is a perspective view showing the configuration of an electronic paper 1400.

As shown in FIG. 19, the electronic paper 1400 is equipped with the electrophoretic display device in accordance with the embodiment described above as a display section 1401. The electronic paper 1400 is flexible and includes a sheet body 1402 composed of a rewritable sheet with texture and flexibility similar to those of ordinary paper.

Figure 20:
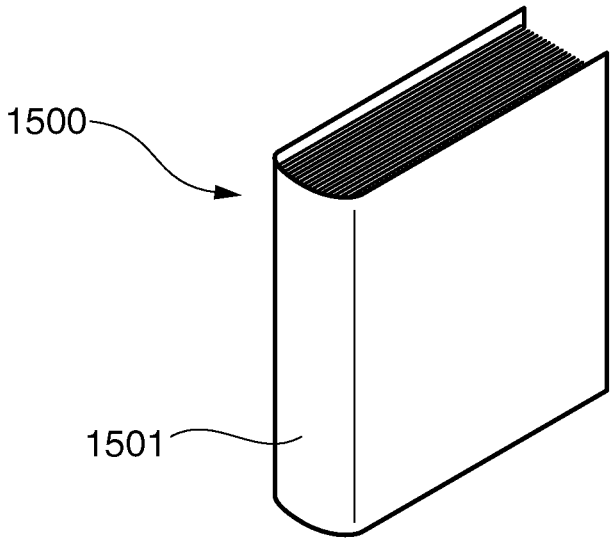
FIG. 20 is a perspective view showing a configuration of an electronic notepad that is an example of an electronic apparatus using the electro -optic device.

FIG. 20 is a perspective view showing the configuration of an electronic notepad 1500.

As shown in FIG. 20, the electronic notepad 1500 is configured such that multiple sheets of electronic paper 1400 shown in FIG. 19 are bundled and placed between covers 1501. The covers 1501 may be equipped with, for example, a display data input device (not shown) for inputting display data transmitted from, for example, an external apparatus. Accordingly, display contents can be changed or updated according to the display data while the multiple sheets of electronic paper are bundled together.

The electronic paper 1400 and the electronic notepad 1500 described above are equipped with the electrophoretic display devices in accordance with the embodiment of the invention described above, such that high quality image display can be performed.

In addition to the above, the electrophoretic display device in accordance with the embodiment described above is also applicable to display sections of other electronic apparatuses, such as, wrist watches, cellular phones, portable audio apparatuses and the like.

The invention is not limited to the embodiments described above, and may be suitably modified within the range that does not depart from the subject matter and the idea of the invention readable from the scope of patent claims and the entire specification, and methods for controlling an electro-optical device, devices for controlling an electro-optical device, electro-optical devices and electronic apparatuses which include such modifications are deemed to be included in the technical scope of the invention.

The entire disclosure of Japanese Patent Application No. 2012-069215, filed Mar. 26, 2012 is expressly incorporated by reference herein.

What is claimed is:

1. A method for controlling an electro -optic device having a display section including a plurality of pixels provided at positions corresponding to intersections between mutually intersecting plural scanning lines and plural data lines, each of the pixels including electro-optic material placed between mutually opposing pixel electrode and counter electrode, and capable of assuming a first limit optical state, a second limit optical state and a plurality of intermediate optical states between the first limit optical state and the second limit optical state, and a drive part that supplies, for displaying an image corresponding to image data at the display section, voltage pulses according to the image data to the pixel electrode of each of the pixels in a plurality of frame periods, the method comprising a control process for changing the pixel to a first intermediate optical state among the plurality of intermediate optical states, the control process including:

a first control step of supplying a first voltage pulse to the pixel electrode until the pixel reaches the first limit optical state;

a second control step of supplying, to the pixel electrode, a second voltage pulse of an opposite polarity with respect to the first voltage pulse after the first control step such that the pixel becomes closer to the first intermediate optical state;

a third control step of supplying a third voltage pulse to the pixel electrode before the first control step; and a fourth control step of supplying, to the pixel electrode, a fourth voltage pulse of an opposite polarity with respect to the third voltage pulse between the third control step and the first control step, each of the third control step and the fourth control step being set to a period that satisfies a relation W (A→B)=−W (B→A), where W (A→B) is an integrated value of drive voltage and drive time when changing the pixel from an optical state A to an optical state B, and W (B→A) is an integrated value of drive voltage and drive time when changing the pixel from the optical state B to the optical state A.

2. A method for controlling an electro-optic device according to claim 1, wherein the period of each of the third control step and the fourth control step is set such that the optical state before the beginning of the third control step is the same as the optical state after the end of the fourth control step.

3. A method for controlling an electro-optic device according to claim 1, wherein the third voltage pulse and the second voltage pulse have the same polarity, and the fourth voltage pulse and the first voltage pulse have the same polarity.

4. A method for controlling an electro-optic device according to claim 1, wherein, in the second control step, the second voltage pulse is supplied to the pixel electrode until the first intermediate optical state or an intermediate optical state that is close to the second limit optical state more than the first intermediate optical state is reached, and the control step for changing the pixel to the first intermediate optical state further includes a fifth control step of supplying, the pixel electrode, a fifth voltage pulse of the same polarity as that of the first voltage pulse until the first intermediate optical state is reached, when, after the second control step, the pixel is in an intermediate optical state that is close to the second limit optical state more than the first intermediate optical state.

5. A method for controlling an electro-optic device according to claim 1, wherein an absolute value of the integrated value W (A→B) of drive voltage and drive time when changing the pixel from the optical state A to the optical state B becomes greater, as an absolute value of a difference between the optical state A to the optical state B becomes greater.

6. A method for controlling an electro-optic device according to claim 1, wherein an integrated value of drive voltage and drive time W (A→C→B) when changing the pixel from the optical state A to an optical state C and then to the optical state B becomes equal to the integrated value of drive voltage and drive time W (A→B) when changing the pixel from the optical state A to the optical state B.

7. A method for controlling an electro-optic device according to claim 1, wherein each of the periods of the third control step and the fourth control step is set by using a weight table decided based on the relation between the optical states and the integrated values of drive voltage and drive time.

8. A method for controlling an electro-optic device according to claim 7, wherein the weight table has one weight value for each reference optical state; and when the weight value of an arbitrary optical state Li is WHT(Li) and the weight value of an optical state Lj is WHT(Lj), the weight value is decided such that the integrated value of drive voltage and drive time W(Li→Lj) when shifting the pixel from the optical state Li to the optical state Lj becomes proportional to WHT(Lj)−WHT (Li).

9. A method for controlling an electro -optic device according to claim 7, wherein the weight table has one weight value for each reference optical state, and the weight value is decided in a manner to increase or decrease monotonously with respect to the optical state.

10. A control device for controlling an electro-optic device having a display section including a plurality of pixels provided at positions corresponding to intersections between mutually intersecting plural scanning lines and plural data lines, each of the pixels including electro-optic material placed between mutually opposing pixel electrode and counter electrode, and capable of assuming a first limit optical state, a second limit optical state and a plurality of intermediate optical states between the first limit optical state and the second limit optical state, and a drive part that supplies, for displaying an image corresponding to image data at the display section, voltage pulses according to the image data to the pixel electrode of each of the pixels in a plurality of frame periods, the control device comprising:

when changing the pixel to a first intermediate optical state among the plurality of intermediate optical states, a first control device that supplies a first voltage pulse to the pixel electrode until the pixel reaches the first limit optical state;

a second control device that supplies, to the pixel electrode, a second voltage pulse of an opposite polarity with respect to the first voltage pulse after the first voltage pulse is supplied by the first control device such that the pixel becomes closer to the first intermediate optical state;

a third control device that supplies a third voltage pulse to the pixel electrode before the first voltage pulse is supplied by the first control device; and a fourth control device that supplies, to the pixel electrode, a fourth voltage pulse of an opposite polarity with respect to the third voltage pulse after the third voltage pulse is supplied by the third control device and before the first voltage pulse is supplied by the first control device, the period in which the third control device supplies the third voltage pulse and the period in which the fourth control device supplies the fourth voltage pulse being set to satisfy a relation of W (A→B)=−W (B→A), where W (A→B) is an integrated value of drive voltage and drive time when changing the pixel from an arbitrary optical state A to an optical state B, and W (B→A) is an integrated value of drive voltage and drive time when changing the pixel from the optical state B to the optical state A.

11. An electro-optic device comprising the control device for controlling an electro-optic device recited in claim 10.

12. An electronic apparatus comprising the electro-optic device recited in claim 11.

* * * * *